US009587287B2

(12) United States Patent
Yokoi et al.

(10) Patent No.: US 9,587,287 B2
(45) Date of Patent: Mar. 7, 2017

(54) BAINITE-CONTAINING-TYPE HIGH-STRENGTH HOT-ROLLED STEEL SHEET HAVING EXCELLENT ISOTROPIC WORKABILITY AND MANUFACTURING METHOD THEREOF

(75) Inventors: Tatsuo Yokoi, Tokyo (JP); Hiroshi Shuto, Tokyo (JP); Riki Okamoto, Tokyo (JP); Nobuhiro Fujita, Tokyo (JP); Kazuaki Nakano, Tokyo (JP); Takeshi Yamamoto, Tokyo (JP)

(73) Assignee: NIPPON STEEL AND SUMITOMO METAL CORPORATION, Tokyo (JP)

( * ) Notice: Subject to any disclaimer, the term of this patent is extended or adjusted under 35 U.S.C. 154(b) by 659 days.

(21) Appl. No.: 13/985,001

(22) PCT Filed: Mar. 29, 2012

(86) PCT No.: PCT/JP2012/058337

§ 371 (c)(1),
(2), (4) Date: Aug. 12, 2013

(87) PCT Pub. No.: WO2012/133636

PCT Pub. Date: Oct. 4, 2012

(65) Prior Publication Data

US 2013/0319582 A1 Dec. 5, 2013

(30) Foreign Application Priority Data

Mar. 31, 2011 (JP) ..... 2011-079658

(51) Int. Cl.

| | |
|---|---|
| ***C21D 8/02*** | (2006.01) |
| ***C22C 38/28*** | (2006.01) |
| ***C22C 38/16*** | (2006.01) |
| ***C22C 38/14*** | (2006.01) |
| ***C21D 9/46*** | (2006.01) |
| ***C22C 38/06*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/38*** | (2006.01) |

(52) U.S. Cl.

CPC ..... *C21D 8/0263* (2013.01); *C21D 8/02* (2013.01); *C21D 8/0205* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/38* (2013.01); *C22C 38/58* (2013.01); *C21D 2201/05* (2013.01); *C21D 2211/002* (2013.01); *C21D 2211/005* (2013.01)

(58) Field of Classification Search

CPC ..... C21D 8/0263; C21D 8/02; C21D 8/0205; C21D 8/0226; C22C 38/001

See application file for complete search history.

(56) References Cited

U.S. PATENT DOCUMENTS

| | | | |
|---|---|---|---|
| 2003/0196735 | A1 | 10/2003 | Sugiura et al. |
| 2004/0244877 | A1 | 12/2004 | Yokoi et al. |
| 2007/0089814 | A1 | 4/2007 | Sugiura et al. |

FOREIGN PATENT DOCUMENTS

| | | | |
|---|---|---|---|
| CN | 1462317 | A | 12/2003 |
| CN | 1599802 | A | 3/2005 |
| CN | 1809646 | A | 7/2006 |
| JP | 6-293910 | A | 10/1994 |
| JP | 10-183255 | A | 7/1998 |
| JP | 2002-115025 | A | 4/2002 |
| JP | 2002-322540 | A | 11/2002 |
| JP | 2002-322541 | A | 11/2002 |
| JP | 2002-363695 | A | 12/2002 |
| JP | 2005-15854 | A | 1/2005 |
| JP | 2006-124789 | A | 5/2006 |

(Continued)

OTHER PUBLICATIONS

Chinese Office Action and Search Report, dated Nov. 25, 2014, for Chinese Application No. 201280014599.3.
Taiwanese Office Action dated Feb. 24, 2014, issued in corresponding Taiwanese Patent Application No. 101111104.
International Search Report issued in PCT/JP2012/058337, dated Jun. 26, 2012.
Written Opinion of the International Searching Authority issued in PCT/JP2012/058337, dated Jun. 26, 2012.

*Primary Examiner* — Jessee Roe
*Assistant Examiner* — Jenny Wu
(74) *Attorney, Agent, or Firm* — Birch, Stewart, Kolasch & Birch, LLP

(57) ABSTRACT

The present invention provides a bainite-containing-type high-strength hot-rolled steel sheet. The steel sheet, containing C: greater than 0.07 to 0.2%, Si: 0.001 to 2.5%, Mn: 0.01 to 4%, P: 0.15% or less, S: 0.03% or less, N: 0.01% or less, Al: 0.001 to 2% and a balance being composed of Fe and impurities, has an average value of pole densities of the {100}<011> to {223}<110> orientation group at a sheet thickness center portion being a range of ⅝ to ⅜ in sheet thickness from the surface of the steel sheet is 4.0 or less, and a pole density of the {332}<113> crystal orientation is 4.8 or less, an average crystal grain diameter is 10 μm or less and vTrs is −20° C. or lower, and a microstructure is composed of 35% or less in a structural fraction of pro-eutectoid ferrite and a balance of a low-temperature transformation generating phase.

6 Claims, 2 Drawing Sheets

(56) References Cited

FOREIGN PATENT DOCUMENTS

| | | | | |
|---|---|---|---|---|
| JP | 2008-69425 | A | | 3/2008 |
| JP | 2009-19265 | A | | 1/2009 |
| JP | 2009-30159 | A | | 2/2009 |
| JP | 2009-263718 | A | | 11/2009 |
| JP | 2009263718 | A | * | 11/2009 |
| TW | 2005-17507 | | | 6/1993 |

* cited by examiner

BAINITE-CONTAINING-TYPE HIGH-STRENGTH HOT-ROLLED STEEL SHEET HAVING EXCELLENT ISOTROPIC WORKABILITY AND MANUFACTURING METHOD THEREOF

TECHNICAL FIELD

The present invention relates to a bainite-containing-type high-strength hot-rolled steel sheet having excellent isotropic workability and a manufacturing method thereof.

This application is based upon and claims the benefit of priority of the prior Japanese Patent Application No. 2011-079658, filed on Mar. 31, 2011, the entire contents of which are incorporated herein by reference.

BACKGROUND ART

In recent years, for weight reduction in various members with the aim of improving fuel efficiency of an automobile, a reduction in thickness by achieving high strength of a steel sheet of iron alloy or the like and application of light metal such as Al alloy have been promoted. However, as compared to heavy metal such as steel, the light metal such as Al alloy has the advantage of specific strength being high, but has the disadvantage of being expensive significantly. Therefore, the application of light metal such as Al alloy has been limited to special use. Thus, in order to promote the weight reduction in various members more inexpensively and widely, the reduction in thickness by achieving high strength of a steel sheet has been needed.

The achievement of high strength of a steel sheet causes deterioration of material properties such as formability (workability) in general. Therefore, how the achievement of high strength is attained without deteriorating the material properties is important in developing a high-strength steel sheet. Particularly, a steel sheet used as an automobile member such as an inner sheet member, a structure member, or an underbody member is required to have bendability, stretch flange workability, burring workability, ductility, fatigue durability, impact resistance, corrosion resistance, and so on according to its use. It is important how these material properties and high strength property should be exhibited in a high-dimensional and well-balanced manner.

Particularly, among automobile parts, a part obtained by working a sheet material as a raw material and exhibiting a function as a rotor, such as a drum or a carrier constituting an automatic transmission, for example, is an important part serving as a mediator of transmitting engine output to an axle shaft. Such a part exhibiting a function as a rotor is required to have circularity as a shape and sheet thickness homogeneity in a circumferential direction in order to decrease friction and the like. Further, for forming such a part, forming methods such as burring, drawing, ironing, and bulging are used, and a great emphasis is placed also on ultimate ductility typified by local elongation.

Further, with regard to a steel sheet used for such a member, it is necessary to improve a property that the steel sheet is formed and then is attached to an automobile as a part and then the member is not easily broken even when being subjected to impact caused by collision or the like. Further, in order to secure the impact resistance in a cold district, it is also necessary to improve low-temperature toughness. This low-temperature toughness is defined by vTrs (a Charpy fracture appearance transition temperature), or the like. For this reason, it is also necessary to consider the impact resistance itself of the above-described steel member.

That is, a thin steel sheet for a part required to have sheet thickness uniformity such as the above-described part is required to have, in addition to excellent workability, plastic isotropy and low-temperature toughness as very important properties.

In order to achieve the high strength property and the various material properties such as formability in particular as above, in Patent Document 1, for example, there has been disclosed a manufacturing method of a steel sheet in which a steel structure is made of 90% or more of ferrite and a balance of bainite, to thereby achieve high strength, ductility, and bore expandability. However, with regard to a steel sheet manufactured by applying the technique disclosed in Patent Document 1, the plastic isotropy is not mentioned at all. On the condition that the steel sheet manufactured in Patent Document 1 is applied to a part required to have circularity and sheet thickness homogeneity in a circumferential direction, a decrease in output due to false vibration and/or friction loss caused by an eccentricity of the part is concerned.

Further, in Patent Documents 2 and 3, there has been disclosed a technique of a high-tensile hot-rolled steel sheet to which high strength and excellent stretch flange formability are provided by adding Mo and making precipitates fine. However, a steel sheet to which the techniques disclosed in Patent Documents 2 and 3 are applied is required to have 0.07% or more of Mo being an expensive alloy element added thereto, and thus has a problem that its manufacturing cost is high. Further, in the techniques disclosed in Patent Documents 2 and 3 as well, the plastic isotropy is not mentioned at all. On the condition that the techniques in Patent Documents 2 and 3 are also applied to a part required to have circularity and sheet thickness homogeneity in a circumferential direction, a decrease in output due to false vibration and/or friction loss caused by an eccentricity of the part is concerned.

On the other hand, with regard to the plastic isotropy of the steel sheet, namely a decrease in plastic anisotropy, in Patent Document 4, for example, there has been disclosed a technique in which endless rolling and lubricated rolling are combined, and thereby a texture of austenite in a shear layer of a surface layer is regulated and in-plane anisotropy of an r value (Lankford value) is decreased. However, in order to perform the lubricated rolling with a small friction coefficient over an entire length of a coil, the endless rolling is needed for preventing biting failure caused by slip between a roll bite and a rolled sheet material during rolling. However, in order to apply this technique, investment in facilities such as a rough bar joining apparatus, a high-speed crop shear, and so on is needed and thus a burden is large.

Further, in Patent Document 5, for example, there has been disclosed a technique in which Zr, Ti, and Mo are compositely added and finish rolling is finished at a high temperature of 950° C. or higher, and thereby strength of 780 MPa class or more is obtained, anisotropy of an r value is small, and stretch flange formability and deep drawability are achieved. However, 0.1% or more of Mo being an expensive alloy element is needed to be added, and thus there is a problem that its manufacturing cost is high.

Further, a study of improving the low-temperature toughness of a steel sheet has been advanced up to now, but a bainite-containing-type high-strength hot-rolled steel sheet having excellent isotropic workability that has high strength, exhibits plastic isotropy, improves hole expandability, and further achieves also low-temperature toughness has not been disclosed in Patent Documents 1 to 5.

PRIOR ART DOCUMENT

Patent Document

Patent Document 1: Japanese Laid-open Patent Publication No. H6-293910

Patent Document 2: Japanese Laid-open Patent Publication No. 2002-322540

Patent Document 3: Japanese Laid-open Patent Publication No. 2002-322541

Patent Document 4: Japanese Laid-open Patent Publication No. H10-183255

Patent Document 5: Japanese Laid-open Patent Publication No. 2006-124789

DISCLOSURE OF THE INVENTION

Problems to be Solved by the Invention

The present invention has been invented in consideration of the above-described problems, and has an object to provide a bainite-containing-type high-strength hot-rolled steel sheet having excellent isotropic workability that has high strength, is applicable to a member required to have workability, hole expandability, bendability, strict sheet thickness uniformity and circularity after working, and low-temperature toughness, and has a steel sheet grade of 540 MPa class or more, and a manufacturing method capable of manufacturing the steel sheet inexpensively and stably.

Means for Solving the Problems

In order to solve the problems as described above, the present inventors propose a bainite-containing-type high-strength hot-rolled steel sheet having excellent isotropic workability and a manufacturing method described below.

[1]

A bainite-containing-type high-strength hot-rolled steel sheet having excellent isotropic workability, contains:

in mass %,

C: greater than 0.07 to 0.2%;

Si: 0.001 to 2.5%;

Mn: 0.01 to 4%;

P: 0.15% or less (not including 0%);

S: 0.03% or less (not including 0%);

N: 0.01% or less (not including 0%);

Al: 0.001 to 2%; and a balance being composed of Fe and inevitable impurities, in which an average value of pole densities of the {100}<011> to {223}<110> orientation group represented by respective crystal orientations of {100}<011>, {116}<110>, {114}<110>, {113}<110>, {112}<110>, {335}<110>, and {223}<110> at a sheet thickness center portion being a range of ⅝ to ⅜ in sheet thickness from the surface of the steel sheet is 4.0 or less, and a pole density of the {332}<113> crystal orientation is 4.8 or less, an average crystal grain diameter is 10 μm or less and a Charpy fracture appearance transition temperature vTrs is −20° C. or lower, and a microstructure is composed of 35% or less in a structural fraction of pro-eutectoid ferrite and a balance of a low-temperature transformation generating phase.

[2]

The bainite-containing-type high-strength hot-rolled steel sheet having excellent isotropic workability according to [1], further contains:

one type or two or more types of in mass %,

Ti: 0.015 to 0.18%,

Nb: 0.005 to 0.06%,

Cu: 0.02 to 1.2%,

Ni: 0.01 to 0.6%,

Mo: 0.01 to 1%,

V: 0.01 to 0.2%, and

Cr: 0.01 to 2%.

[3]

The bainite-containing-type high-strength hot-rolled steel sheet having excellent isotropic workability according to [1], further contains:

one type or two or more types of in mass %,

Mg: 0.0005 to 0.01%,

Ca: 0.0005 to 0.01%, and

REM: 0.0005 to 0.1%.

[4]

The bainite-containing-type high-strength hot-rolled steel sheet having excellent isotropic workability according to [1], further contains:

in mass %,

B: 0.0002 to 0.002%.

[5]

A manufacturing method of a bainite-containing-type high-strength hot-rolled steel sheet having excellent isotropic workability, includes:

on a steel billet containing:

in mass %,

C: greater than 0.07 to 0.2%;

Si: 0.001 to 2.5%;

Mn: 0.01 to 4%;

P: 0.15% or less (not including 0%);

S: 0.03% or less (not including 0%);

N: 0.01% or less (not including 0%);

Al: 0.001 to 2%; and a balance being composed of Fe and inevitable impurities, performing first hot rolling in which rolling at a reduction ratio of 40% or more is performed one time or more in a temperature range of not lower than 1000° C. nor higher than 1200° C.;

performing second hot rolling in which rolling at 30% or more is performed in one pass at least one time in a temperature region of not lower than T1+30° C. nor higher than T1+200° C. determined by Expression (1) below; and setting the total of reduction ratios in the second hot rolling to 50% or more;

performing final reduction at a reduction ratio of 30% or more in the second hot rolling and then starting primary cooling in a manner that a waiting time period t second satisfies Expression (2) below;

setting an average cooling rate in the primary cooling to 50° C./second or more and performing the primary cooling in a manner that a temperature change is in a range of not lower than 40° C. nor higher than 140° C.;

within three seconds after completion of the primary cooling, performing secondary cooling in which cooling is performed at an average cooling rate of 15° C./second or more; and after completion of the secondary cooling, performing air cooling for 1 to 20 seconds in a temperature region of lower than an Ar3 transformation point temperature and an Ar1 transformation point temperature or higher and next performing coiling at 450° C. or higher and lower than 550° C.

$$T1(°\ C.)=850+10\times(C+N)+Mn+350\times Nb+250\times Ti+40\times B+10\times Cr+100\times Mo+100\times V \quad (1)$$

Here, C, N, Mn, Nb, Ti, B, Cr, Mo, and V each represent the content of the element (mass %).

$$t\leq 2.5\times t1 \quad (2)$$

Here, t1 is obtained by Expression (3) below.

$$t1=0.001\times((Tf-T1)\times P1/100)^2-0.109\times((Tf-T1)\times P1/100)+3.1 \quad (3)$$

Here, in Expression (3) above, Tf represents the temperature of the steel billet obtained after the final reduction at a reduction ratio of 30% or more, and P1 represents the reduction ratio of the final reduction at 30% or more.

[6]

The manufacturing method of the bainite-containing-type high-strength hot-rolled steel sheet having excellent isotropic workability according to [5], in which the total of reduction ratios in a temperature range of lower than T1+30° C. is 30% or less.

[7]

The manufacturing method of the bainite-containing-type high-strength hot-rolled steel sheet having excellent isotropic workability according to [5], in which heat generation by working between respective passes in the temperature region of not lower than T1+30° C. nor higher than T1+200° C. in the second hot rolling is 18° C. or lower.

[8]

The manufacturing method of the bainite-containing-type high-strength hot-rolled steel sheet having excellent isotropic workability according to [5], in which the waiting time period t second further satisfies Expression (4) below.

$$t<t1 \quad (4)$$

[9]

The manufacturing method of the bainite-containing-type high-strength hot-rolled steel sheet having excellent isotropic workability according to [5], in which the waiting time period t second further satisfies Expression (5) below.

$$t1\leq t\leq t1\times 2.5 \quad (5)$$

[10]

The manufacturing method of the bainite-containing-type high-strength hot-rolled steel sheet having excellent isotropic workability according to [5], in which the primary cooling is started between rolling stands.

Effect of the Invention

According to the present invention, there is provided a steel sheet applicable to a member required to have workability, hole expandability, bendability, strict sheet thickness uniformity and circularity after working, and low-temperature toughness (an inner sheet member, a structure member, an underbody member, an automobile member such as a transmission, and members for shipbuilding, construction, bridges, offshore structures, pressure vessels, line pipes, and machine parts, and so on). Further, according to the present invention, there is manufactured a high-strength steel sheet having excellent low-temperature toughness and 540 MPa class or more inexpensively and stably.

MODE FOR CARRYING OUT THE INVENTION

Figure 1:
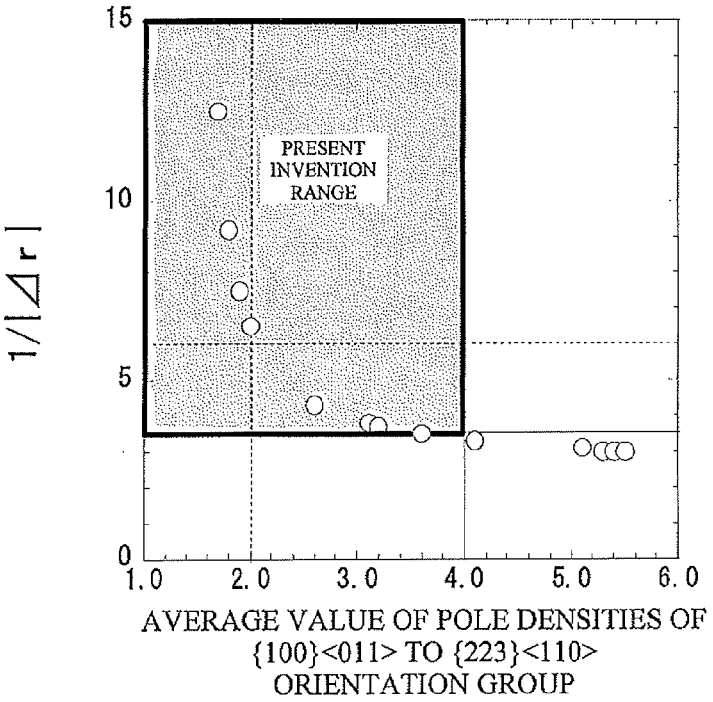
FIG. 1 is a view showing the relationship between an average value of pole densities of the {100}<011> to {223}<110> orientation group and isotropy (1/|Δr|)

As an embodiment implementing the present invention, there will be explained a bainite-containing-type high-strength hot-rolled steel sheet having excellent isotropic workability, (which will be simply called a "hot-rolled steel sheet" hereinafter), in detail. Incidentally, mass % related to a chemical composition is simply described as %.

The present inventors earnestly studied the bainite-containing-type high-strength hot-rolled steel sheet suitable for application to a member required to have workability, hole expandability, bendability, strict sheet thickness uniformity and circularity after working, and low-temperature toughness, in terms of workability and further achievement of isotropy and low-temperature toughness. As a result, the following new knowledge was obtained.

First, for obtaining the isotropy (decreasing anisotropy), formation of a transformation texture from non-recrystallized austenite, being the cause of anisotropy, is avoided. In order to achieve it, it is necessary to promote recrystallization of austenite after finish rolling. As its means, an optimum rolling pass schedule in finish rolling and achievement of high temperature of a rolling temperature are effective.

Next, for improving the low-temperature toughness, making grains fine in each fracture of a brittle fracture, namely grain refining in each microstructure is effective. For this, it is effective to increase nucleation sites for α at the time of transformation of γ to α, and it becomes necessary to increase crystal grain boundaries of austenite that can be the nucleation sites and dislocation density.

As its means, it becomes necessary to perform rolling at a γ to α transformation point temperature or higher and at as low a temperature as possible, namely to make austenite remain non-recrystallized and in a state of a non-recrystallization fraction being high, cause the γ to α transformation. This is because austenite grains after recrystallization grow quickly at a recrystallization temperature, become coarse for an extremely short time, and become coarse even in an α phase after the γ to α transformation to thereby cause significant toughness deterioration.

The present inventors invented an entirely new hot rolling method capable of, on a higher level, balancing the isotropy and the low-temperature toughness, which were considered difficult to be achieved because they resulted in conditions opposite to each other by a normal hot rolling means.

First, as for the isotropy, the present inventors obtained the following knowledge with regard to the relationship between isotropy and texture.

In order to obtain the sheet thickness uniformity and circularity that satisfy a part property in a state where the steel sheet remains worked without being subjected to trimming and cutting processes, at least an isotropic index (=1/|Δr|) is needed to be 3.5 or more.

Here, the isotropic index is obtained in a manner that the steel sheet is worked into a No. 5 test piece described in JIS Z 2201 and the test piece is subjected to a test by the method described in JIS Z 2241. 1/|Δr| being the isotropic index is defined as Δr=(rL−2×r45+rC)/2, where plastic strain ratios (r values: Lankford values) in a rolling direction, in a 45° direction with respect to the rolling direction, and in a 90° direction with respective to the rolling direction (sheet width direction) are defined as rL, r45, and rC respectively.

(Crystal Orientation)

As shown in FIG. 1, the isotropic index (=1/|Δr|) satisfies 3.5 or more as long as an average value of pole densities of the {100}<011> to {223}<110> orientation group represented by respective crystal orientations of {100}<011>, {116}<110>, {114}<110>, {113}<110>, {112}<110>, {335}<110>, and {223}<110> at a sheet thickness center portion being a range of ⅝ to ⅜ in sheet thickness from the surface of the steel sheet is 4.0 or less. As long as the isotropic index is 6.0 or more desirably, the sheet thickness uniformity and circularity that sufficiently satisfy the part property in a state where the steel sheet remains worked can be obtained even though variations in a coil are considered. Therefore, the average value of the pole densities of the {100}<011> to {223}<110> orientation group is desirably 2.0 or less.

The pole density is synonymous with an X-ray random intensity ratio. The pole density (X-ray random intensity ratio) is a numerical value obtained by measuring X-ray intensities of a standard sample not having concentration in a specific orientation and a test sample under the same conditions by X-ray diffractometry or the like and dividing the obtained X-ray intensity of the test sample by the X-ray intensity of the standard sample. This pole density can be measured by any one of X-ray diffractometry, an EBSP (Electron Back Scattering Pattern) method, and an ECP (Electron Channeling Pattern) method.

As for the pole density of the {100}<011> to {223}<110> orientation group, for example, pole densities of respective orientations of {100}<011>, {116}<110>, {114}<110>, {112}<110>, and {223}<110> are obtained from a three-dimensional texture (ODF) calculated by a series expansion method using a plurality (preferably three or more) of pole figures out of pole figures of {110}, {100}, {211}, and {310} measured by the method, and these pole densities are arithmetically averaged, and thereby the pole density of the above-described orientation group is obtained. Incidentally, when it is impossible to obtain the intensities of all the above-described orientations, the arithmetic average of the pole densities of the respective orientations of {100}<011>, {116}<110>, {114}<110>, {112}<110>, and {223}<110> may also be used as a substitute.

For example, for the pole density of each of the above-described crystal orientations, each of intensities of (001)[1-10], (116)[1-10], (114)[1-10], (113)[1-10], (112)[1-10], (335)[1-10], and (223)[1-10] at a φ2=45° cross-section in the three-dimensional texture may be used as it is.

Figure 2:
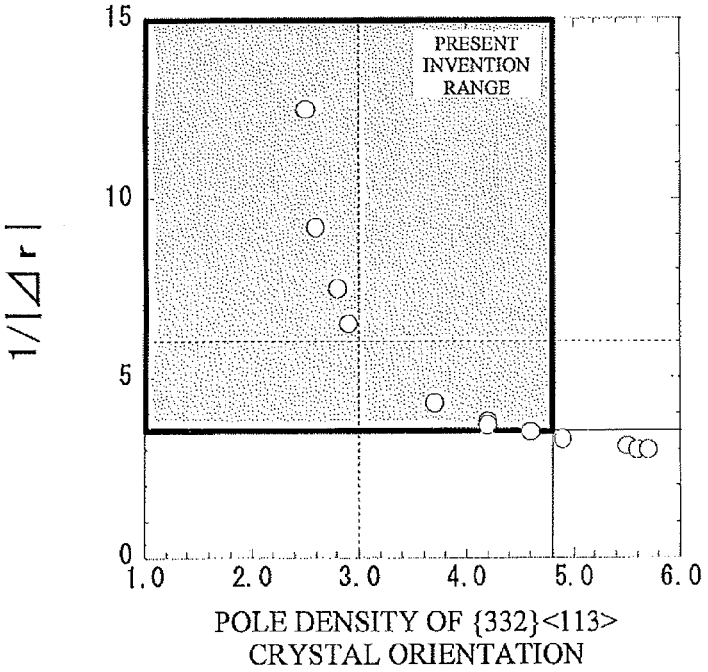
FIG. 2 is a view showing the relationship between a pole density of the {332}<113> crystal orientation and an isotropic index (1/|Δr|)

Similarly, as shown in FIG. 2, as long as the pole density of the {332}<113> crystal orientation at the sheet thickness center portion being the range of ⅝ to ⅜ in sheet thickness from the surface of the steel sheet is 4.8 or less, the isotropic index satisfies 3.5 or more. As long as the isotropic index is 6.0 or more desirably, the sheet thickness uniformity and circularity that sufficiently satisfy the part property in a state where the steel sheet remains worked can be obtained even though variations in a coil are considered. Therefore, the pole density of the {332}<113> crystal orientation is desirably 3.0 or less.

With regard to the sample to be subjected to the X-ray diffractometry, EBSP method, or ECP method, the steel sheet is reduced in thickness to a predetermined sheet thickness from the surface by mechanical polishing or the like. Next, strain is removed by chemical polishing, electrolytic polishing, or the like, and the sample is manufactured in such a manner that in the range of ⅝ to ⅜ in sheet thickness, an appropriate plane becomes a measuring plane. For example, on a steel piece in a size of 30 mmφ cut out from the position of ¼ W or ¾ W of the sheet width W, grinding with fine finishing (centerline average roughness Ra: 0.4a to 1.6a) is performed. Next, by chemical polishing or electrolytic polishing, strain is removed, and the sample to be subjected to the X-ray diffractometry is manufactured. With regard to the sheet width direction, the steel piece is desirably taken from, of the steel sheet, the position of ¼ or ¾ from an end portion.

As a matter of course, the pole density satisfies the above-described pole density limited range not only at the sheet thickness center portion being the range of ⅝ to ⅜ in sheet thickness from the surface of the steel sheet, but also at as many thickness positions as possible, and thereby local ductile performance (local elongation) is further improved. However, the range of ⅝ to ⅜ from the surface of the steel sheet is measured, to thereby make it possible to represent the material property of the entire steel sheet generally. Thus, ⅝ to ⅜ of the sheet thickness is defined as the measuring range.

Incidentally, the crystal orientation represented by {hkl}<uvw> means that the normal direction of the steel sheet plane is parallel to <hkl> and the rolling direction is parallel to <uvw>. With regard to the crystal orientation, normally, the orientation vertical to the sheet plane is represented by [hkl] or {hkl} and the orientation parallel to the rolling direction is represented by (uvw) or <uvw>. {hkl}, <uvw>, and so on are generic terms for equivalent planes, and [hkl], (uvw) each indicate an individual crystal plane. That is, in the present invention, a body-centered cubic structure is targeted, and thus, for example, the (111), (−111), (1-11), (11-1), (−1-11), (−11-1), (1-1-1), and (−1-1-1) planes are equivalent to make it impossible to make them different. In such a case, these orientations are generically referred to as {111}. In an ODF representation, [hkl](uvw) is also used for representing orientations of other low symmetric crystal structures, and thus it is general to represent each orientation as [hkl](uvw), but in the present invention, [hkl](uvw) and {hkl}<uvw> are synonymous with each other. The measurement of crystal orientation by an X ray is performed according to the method described in, for example, Cullity, Elements of X-ray Diffraction, new edition (published in 1986, translated by MATSUMURA, Gentaro, published by AGNE Inc.) on pages 274 to 296.

(Average Crystal Grain Diameter)

Next, the present inventors examined the low-temperature toughness.

Figure 3:
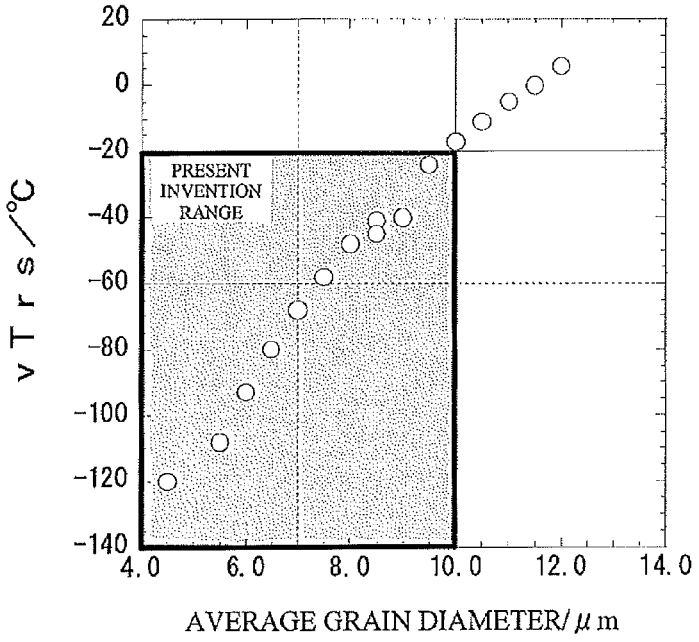
FIG. 3 is a view showing the relationship between an average crystal grain diameter (μm) and vTrs (° C.)

FIG. 3 shows the relationship between an average crystal grain diameter and vTrs (a Charpy fracture appearance transition temperature). As the average crystal grain diameter is smaller, vTrs becomes low in temperature, and the toughness at low temperature is improved. As long as the average crystal grain diameter is 10 μm or less, vTrs becomes −20° C. or lower as a target, and thus the present invention is durable enough to be used in a cold district.

Incidentally, the low-temperature toughness was evaluated by vTrs (the Charpy fracture appearance transition temperature) obtained by a V-notch Charpy impact test. In the V-notch Charpy impact test, a test piece was made based on JISZ2202 and the test was performed according to the contents defined in JISZ2242, and vTrs was measured.

Further, the low-temperature toughness is greatly affected by the average crystal grain diameter of the structure, and thus the measurement of the average crystal grain diameter in the sheet thickness center portion was also performed. A microsample was cut out to have a crystal grain diameter and microstructure thereof measured by using EBSP-OIM™ (Electron Back Scatter Diffraction Pattern-Orientation Image Microscopy). The microsample was polished by using a colloidal silica abrasive for 30 to 60 minutes to be made and was subjected to an EBSP measurement under measurement conditions of 400 magnifications, 160 μm×256 μm area, and a measurement step of 0.5 μm.

The EBSP-OIM™ method is constituted by a device and software that a highly inclined sample in a scanning electron microscope (SEM) is irradiated with electron beams, a Kikuchi pattern formed by backscattering is photographed by a high-sensitive camera and is image processed by a computer, and thereby a crystal orientation at an irradiation point is measured for a short time period.

In the EBSP method, it is possible to quantitatively analyze a microstructure and a crystal orientation of a bulk sample surface. An analysis area of the EBSP method is an area capable of being observed by the SEM. It is possible to analyze the area with a minimum resolution of 20 nm by the EBSP method, depending on the resolution of the SEM. The analysis is performed by mapping an area to be analyzed to tens of thousands of equally-spaced grid points. It is possible to see crystal orientation distributions and sizes of crystal grains within the sample in a polycrystalline material.

In the present invention, from an image mapped in a manner that an orientation difference between crystal grains is defined as 15° being a threshold value of a large angle tilt grain boundary recognized as a crystal grain boundary generally, the crystal grains were visualized and the average crystal grain diameter was obtained. Here, the "average crystal grain diameter" is a value obtained by the EBSP-OIM™.

As described above, the present inventors revealed respective requirements necessary for the steel sheet for obtaining the isotropy and the low-temperature toughness.

The average crystal grain diameter directly related to the low-temperature toughness becomes small as a finish rolling finishing temperature is lower, and thus the low-temperature toughness is improved. However, the average value of the pole densities of the {100}<011> to {223}<110> orientation group at the sheet thickness center portion corresponding to ⅝ to ⅜ from the surface of the steel sheet and the pole density of the {332}<113> crystal orientation, which are one of control factors of the isotropy, are inversely correlated to the average crystal grain diameter. That is, it is the relation in which when the average crystal grain diameter is decreased in order to improve the low-temperature toughness, the average value of the pole densities of the {100}<011> to {223}<110> orientation group and the pole density of the {332}<113> crystal orientation are increased and thus the isotropy deteriorates. The technique achieving the isotropy and the low-temperature toughness has not been disclosed so far at all.

The present inventors earnestly examined the bainite-containing-type high-strength hot-rolled steel sheet suitable for application to a member required to have workability, hole expandability, bendability, strict sheet thickness uniformity and circularity after working, and low-temperature toughness and allowing the isotropy and the low-temperature toughness to be achieved and a manufacturing method thereof. As a result, the present inventors thought of a hot-rolled steel sheet made of the following conditions and a manufacturing method thereof.

(Chemical Composition)

First, there will be explained reasons for limiting a chemical composition of the bainite-containing-type high-strength hot-rolled steel sheet of the present invention, (which will be sometimes called a "present invention hot-rolled steel sheet" hereinafter).

C: Greater than 0.07 to 0.2%

C is an element contributing to increasing the strength of the steel, but is also an element generating iron-based carbide such as cementite ($Fe_3C$) to be the starting point of cracking at the time of hole expansion. When C is 0.07% or less, it is not possible to obtain a strength improving effect by a low-temperature transformation generating phase. On the other hand, when C exceeds 0.2%, center segregation becomes noticeable and iron-based carbide such as cementite ($Fe_3C$) to be the starting point of cracking in a secondary shear surface at the time of punching is increased, resulting in that a punching property deteriorates. Therefore, C is set to greater than 0.07 to 0.2%. When the balance between strength and ductility is considered, C is desirably 0.15% or less.

Si: 0.001 to 2.5%

Si is an element contributing to increasing the strength of the steel and also has a part as a deoxidizing material of molten steel, and thus is added according to need. When Si is 0.001% or more, the above-described effect is exhibited, but when Si exceeds 2.5%, a strength increasing effect is saturated. Therefore, Si is set to 0.001 to 2.5%.

Further, when being greater than 0.1%, Si, with an increase in the content, suppresses precipitation of iron-based carbide such as cementite and contributes to improving the strength and to improving the hole expandability. However, when Si exceeds 1.0%, an effect of suppressing the precipitation of iron-based carbide is saturated. Therefore, Si is preferably greater than 0.1 to 1.0%.

Mn: 0.01 to 4%

Mn is an element contributing to improving the strength by solid-solution strengthening and quenching strengthening and is added according to need. When Mn is less than 0.01%, its addition effect cannot be obtained, and when Mn exceeds 4%, on the other hand, the addition effect is saturated, and thus Mn is set to 0.01 to 4%.

In order to suppress occurrence of hot cracking by S, when elements other than Mn are not added sufficiently, the Mn amount allowing the Mn amount (mass %) ([Mn]) and the S amount (mass %) ([S]) to satisfy [Mn]/[S]≥20 is desirably added. Further, Mn is an element that, with an increase in the content, expands an austenite region temperature to a low temperature side, improves the hardenability, and facilitates formation of a continuous cooling transformation structure having excellent burring. When Mn is less than 1%, this effect is not easily exhibited, and thus Mn is desirably 1% or more.

P: 0.15% or Less

P is an impurity contained in molten iron, and is an element that is segregated at grain boundaries and decreases the toughness. For this reason, it is desirable as P is smaller, and when exceeding 0.15%, P adversely affects the workability and weldability, and thus P is set to 0.15% or less. Particularly, when the hole expandability and the weldability are considered, P is desirably 0.02% or less. Incidentally, it is difficult to set P to 0% in terms of operation, and thus 0% is not included.

S: 0.03% or Less

S is an impurity contained in molten iron, and is an element that not only causes cracking at the time of hot rolling but also generates an A-based inclusion deteriorating the hole expandability. For this reason, S should be decreased as much as possible, but as long as S is 0.03% or less, it falls within an allowable range, and thus S is set to 0.03% or less. However, when the hole expandability to such extent is needed, S is preferably 0.01% or less, and is more preferably 0.005% or less. Incidentally, it is difficult to set 5 to 0% in terms of operation, and thus 0% is not included.

Al: 0.001 to 2%

For molten steel deoxidation in a refining process of the steel, 0.001% or more of Al is added, but the upper limit is set to 2% because an increase in cost is caused. When Al is added in large amounts, the content of non-metal inclusions is increased and the ductility and the toughness deteriorate, and thus Al is desirably 0.06% or less. It is further desirably 0.04% or less.

Al is an element having a function of suppressing precipitation of iron-based carbide such as cementite in the structure, similarly to Si. For obtaining this function effect, Al is desirably 0.016% or more. It is further desirably 0.016 to 0.04%.

N: 0.01% or Less

N is an element that should be decreased as much as possible, but as long as N is 0.01% or less, it falls within an allowable range. In terms of aging resistance, however, N is desirably 0.005% or less. Incidentally, it is difficult to set N to 0% in terms of operation, and thus 0% is not included.

The present invention hot-rolled steel sheet may also contain one type or two or more types of Ti, Nb, Cu, Ni, Mo, V, and Cr according to need. The present invention hot-rolled steel sheet may also further contain one type or two or more types of Mg, Ca, and REM.

Hereinafter, there will be explained reasons for limiting chemical compositions of the above-described elements.

Ti, Nb, Cu, Ni, Mo, V, and Cr each are an element improving the strength by precipitation strengthening or solid-solution strengthening, and one type or two or more types of these elements may also be added.

However, when Ti, is less than 0.015%, Nb is less than 0.005%, Cu is less than 0.02%, Ni, is less than 0.01%, Mo is less than 0.01%, V is less than 0.01%, and Cr is less than 0.01%, their addition effects cannot be obtained sufficiently.

On the other hand, when Ti is greater than 0.18%, Nb is greater than 0.06%, Cu is greater than 1.2%, Ni is greater than 0.6%, Mo is greater than 1%, V is greater than 0.2%, and Cr is greater than 2%, the addition effects are saturated and economic efficiency decreases. Therefore, it is desirable that Ti is 0.015 to 0.18%, Nb is 0.005 to 0.6%, Cu is 0.02 to 1.2%, Ni is 0.01 to 0.6%, Mo is 0.01 to 1%, V is 0.01 to 0.2%, and Cr is 0.01 to 2%.

Mg, Ca, and REM (rare-earth element) each are an element that controls the form of non-metal inclusions to be the starting point of fracture to cause the deterioration of the workability and improves the workability, and one type or two or more types of these elements may also be added. When Mg, Ca, and REM are each less than 0.0005%, their addition effects are not exhibited.

On the other hand, when Mg is greater than 0.01%, Ca is greater than 0.01%, and REM is greater than 0.1%, the addition effects are saturated and economic efficiency decreases. Therefore, it is desirable that Mg is 0.0005 to 0.01%, Ca is 0.0005 to 0.01%, and REM is 0.0005 to 0.1%.

Incidentally, the present invention hot-rolled steel sheet may also contain 1% or less in total of one type or two or more types of Zr, Sn, Co, Zn, and W within a range that does not impair the characteristics of the present invention hot-rolled steel sheet. However, Sn is desirably 0.05% or less in order to suppress occurrence of a flaw at the time of hot rolling.

B: 0.0002 to 0.002%

B is an element that increases the hardenability and increases a structural fraction of the low-temperature transformation generating phase being a hard phase and thus is added according to need. When B is less than 0.0002%, its addition effect cannot be obtained, and when B exceeds 0.002%, on the other hand, the addition effect is saturated, and further there is a risk that the recrystallization of austenite in hot rolling is suppressed and the $\gamma$ to $\alpha$ transformation texture from non-recrystallized austenite is strengthened to deteriorate the isotropy. Therefore, B is set to 0.0002 to 0.002%.

Further, B is also an element causing slab cracking in a cooling process after continuous casting, and from this viewpoint, is desirably 0.0015% or less. It is desirably 0.001 to 0.0015%.

(Microstructure)

Next, there will be explained metallurgical factors such as a microstructure of the present invention hot-rolled steel sheet in detail.

The microstructure of the present invention hot-rolled steel sheet is composed of 35% or less in a structural fraction of pro-eutectoid ferrite and a balance of the low-temperature transformation generating phase. The low-temperature transformation generating phase means a continuous cooling transformation structure, and is a structure recognized as bainite in general.

Generally, steel sheets having the same tensile strength are compared, and then where a microstructure is an uniform structure occupied by a structure such as the continuous cooling transformation structure, the microstructure shows a tendency to be excellent in local elongation as is typified by a hole expanding value, for example. Where the microstructure is a composite structure composed of pro-eutectoid ferrite being a soft phase and a hard low-temperature transformation generating phase (continuous cooling transformation structure, including martensite in MA), the microstructure shows a tendency to be excellent in uniform elongation that is typified by a work hardening coefficient n value.

In the present invention hot-rolled steel sheet, the microstructure is designed to be the composite structure composed of 35% or less in a structural fraction of pro-eutectoid ferrite and a balance of the low-temperature transformation generating phase in order to ultimately balance the local elongation as is typified by the bendability and the uniform elongation.

When pro-eutectoid ferrite is greater than 35%, the bendability being an index of the local elongation decreases significantly, but the uniform elongation is not so improved, and thus the balance between the local elongation and the uniform elongation deteriorates. The lower limit of the structural fraction of pro-eutectoid ferrite is not limited in particular, but when the structural fraction is 5% or less, a decrease in the uniform elongation becomes significant, and thus the structural fraction of pro-eutectoid ferrite is preferably greater than 5%.

The continuous cooling transformation structure (Zw) (low-temperature transformation generating phase) of the present invention hot-rolled steel sheet is a microstructure defined as a transformation structure positioned in the middle of a microstructure containing polygonal ferrite and pearlite to be generated by a diffusive mechanism and martensite to be generated by a non-diffusive shearing mechanism, as is described in The Iron and Steel Institute of Japan, Society of basic research, Bainite Research Committee/Edition; Recent Research on Bainitic Microstructures and Transformation Behavior of Low Carbon Steels—Final Report of Bainite Research Committee (in 1994, The Iron and Steel Institute of Japan) ("reference literature").

That is, the continuous cooling transformation structure (Zw) (low-temperature transformation generating phase) is defined as a microstructure mainly composed of Bainitic ferrite ($\alpha^{\circ}_{B}$), Granular bainitic ferrite ($\alpha_B$), and Quasi-polygonal ferrite ($\alpha_q$), and further containing a small amount of retained austenite ($\gamma_r$) and Martensite-austenite (MA) as is described in the above-described reference literature on pages 125 to 127 as an optical microscopic observation structure.

Incidentally, similarly to polygonal ferrite (PF), an internal structure of $\alpha_q$ does not appear by etching, but a shape of $\alpha_q$ is acicular, and it is definitely distinguished from PF. Here, of a targeted crystal grain, a peripheral length is set to lq and a circle-equivalent diameter is set to dq, and then a grain having a ratio (lq/dq) satisfying lq/dq≥3.5 is $\alpha_q$.

The continuous cooling transformation structure (Zw) (low-temperature transformation generating phase) of the present invention hot-rolled steel sheet is a microstructure containing one type or two or more types of $\alpha^{\circ}_{B}$, $\alpha_B$, and $\alpha_q$. Further, the continuous cooling transformation structure (Zw) (low-temperature transformation generating phase) of the present invention hot-rolled steel sheet may also further contain one of a small amount of $\gamma_r$ and MA, or both of them, in addition to one type or two or more types of $\alpha^{\circ}_{B}$, $\alpha_B$, and $\alpha_q$. Incidentally, the total content of $\gamma_r$ and MA is set to 3% or less in a structural fraction.

There is sometimes a case that the continuous cooling transformation structure (Zw) (low-temperature transformation generating phase) is not easily discerned by observation by optical microscope in etching using a nital reagent. In such a case, it is discerned by using the EBSP-OIM™. The EBSP-OIM™ (Electron Back Scatter Diffraction Pattern-Orientation Image Microscopy) method is constituted by a device and software in which a highly inclined sample in a scanning electron microscope (Scanning Electron Microscope) is irradiated with electron beams, a Kikuchi pattern formed by backscattering is photographed by a high-sensitive camera and is image processed by a computer, and thereby a crystal orientation at an irradiation point is measured for a short time period.

In the EBSP method, it is possible to quantitatively analyze a microstructure and a crystal orientation of a bulk sample surface. As long as an area to be analyzed by the EBSP method is within an area capable of being observed by the SEM, it is possible to analyze the area with a minimum resolution of 20 nm, depending on the resolution of the SEM.

The analysis by the EBSP-OIM™ method is performed by mapping an area to be analyzed to tens of thousands of equally-spaced grid points. It is possible to see crystal orientation distributions and sizes of crystal grains within the sample in a polycrystalline material. In the present invention hot-rolled steel sheet, one discernible from a mapped image with an orientation difference between packets defined as 15° may also be defined as a grain diameter of the continuous cooling transformation structure (Zw) (low-temperature transformation generating phase) for convenience. In this case, a large angle tilt grain boundary having a crystal orientation difference of 15° or more is defined as a grain boundary.

Further, the structural fraction of pro-eutectoid ferrite was obtained by a Kernel Average Misorientation (KAM) method being equipped with the EBSP-OIM™. The KAM method is that a calculation, in which orientation differences among pixels of first approximations being adjacent six pixels of a certain regular hexagon of measurement data, or second approximations being 12 pixels positioned outside the six pixels, or third approximations being 18 pixels positioned further outside the 12 pixels are averaged and an obtained value is set to a value of the center pixel, is performed with respect to each pixel.

This calculation is performed so as not to exceed a grain boundary, thereby making it possible to create a map representing an orientation change within a grain. That is, this map represents a distribution of strain based on a local orientation change within a grain. Note that in the analysis, the condition of which in the EBSP-OIM™, the orientation difference among adjacent pixels is calculated is set to the third approximation and one having this orientation difference being 5° or less is displayed.

In examples of the present invention, the condition of which in the EBSP-OIM (registered trademark), the orientation difference among adjacent pixels is calculated is set to the third approximation and this orientation difference is set to 5° or less, and the above-described orientation difference third approximation is greater than 1°, which is defined as the continuous cooling transformation structure (Zw) (low-temperature transformation generating phase), and it is 1° or less, which is defined as ferrite. This is because polygonal pro-eutectoid ferrite transformed at high temperature is generated in a diffusion transformation, and thus a dislocation density is small and strain within the grain is small, and thus, a difference within the grain in the crystal orientation is small, and according to the results of various examinations that have been performed so far by the present inventors, a volume fraction of polygonal ferrite obtained by observation of optical microscope and an area fraction of an area obtained by 1° or less of the orientation difference third approximation measured by the KAM method substantially agree with each other.

(Manufacturing Method)

Next, there will be explained conditions of a manufacturing method of the present invention hot-rolled steel sheet, (which will be called a "present invention manufacturing method," hereinafter).

The present inventors explored hot rolling conditions making austenite recrystallize sufficiently after finish rolling or during finish rolling in order to secure the isotropy but suppressing grain growth of recrystallized grains as much as possible and achieving the isotropy and the low-temperature toughness.

First, in the present invention manufacturing method, a manufacturing method of a steel billet to be performed prior to a hot rolling process is not particularly limited. That is, in the manufacturing method of the steel billet, subsequent to a melting process by a shaft furnace, a steel converter, an electric furnace, or the like, in various secondary refining processes, a component adjustment is performed so as to be an aimed chemical composition. Next, a casting process may also be performed by normal continuous casting, or casting by an ingot method, or further a method such as thin slab casting.

Incidentally, a scrap may also be used for a raw material. Further, when a slab is obtained by continuous casting, the slab may be directly transferred to a hot rolling mill as it is in a high-temperature cast slab state, or it may also be cooled to a room temperature and then reheated in a heating furnace, and then hot rolled.

The slab obtained by the above-described manufacturing method is heated in a slab heating process prior to the hot rolling process, but in the present invention manufacturing method, a heating temperature is not determined in particular. However, when the heating temperature is higher than 1260° C., a yield decreases due to scale off, and thus the heating temperature is preferably 1260° C. or lower. On the other hand, when the heating temperature is lower than 1150° C., operational efficiency deteriorates significantly in terms of a schedule, and thus the heating temperature is desirably 1150° C. or higher.

Further, a heating time period in the slab heating process is not determined in particular, but in terms of avoiding central segregation and the like, after the temperature reaches a predetermined heating temperature, the heating temperature is desirably maintained for 30 minutes or longer. However, when the cast slab after being subjected to casting is directly transferred to a hot rolling mill as it is in a high-temperature cast slab state to be rolled, the heating time period is not limited to this.

(First Hot Rolling)

After the slab heating process, the slab extracted from the heating furnace is subjected to a rough rolling process being first hot rolling to be rough rolled without a wait, and thereby a rough bar is obtained.

The rough rolling process (first hot rolling) is performed at a temperature of not lower than 1000° C. nor higher than 1200° C. for reasons to be explained below. When a rough rolling finishing temperature is lower than 1000° C., reduction is performed in a state where the vicinity of a surface layer of the rough bar is in a non-recrystallization temperature region, the texture is developed, and the isotropy deteriorates. Further, hot deformation resistance in the rough rolling increases, to thereby cause a risk that an impediment is caused to the rough rolling operation.

On the other hand, when the rough rolling finishing temperature is higher than 1200° C., the average crystal grain diameter is increased to decrease the toughness. Further, a secondary scale to be generated during the rough rolling grows too much, to thereby make it difficult to remove the scale in descaling or finish rolling to be performed later. When the rough rolling finishing temperature is higher than 1150° C., there is sometimes a case that inclusions are drawn and the hole expandability deteriorates, and thus it is desirably 1150° C. or lower.

Further, in the rough rolling process (first hot rolling), in a temperature range of not lower than 1000° C. nor higher than 1200° C., rolling at a reduction ratio of 40% or more is performed one time or more. When the reduction ratio in the rough rolling process is less than 40%, the average crystal grain diameter is increased and the toughness decreases. When the reduction ratio is 40% or more, the crystal grain diameter becomes uniform and small. On the other hand, when the reduction ratio is greater than 65%, there is sometimes a case that inclusions are drawn and the hole expandability deteriorates, and thus it is desirably 65% or less. Incidentally, in the rough rolling, when the reduction ratio at a final stage and the reduction ratio at a stage prior to the final stage are less than 20%, the average crystal grain diameter is increased easily, and thus in the rough rolling, the reduction ratio at the final stage and the reduction ratio at the stage prior to the final stage are desirably 20% or more.

Incidentally, in terms of decreasing the average crystal grain diameter of a final product, an austenite grain diameter after the rough rolling, namely before the finish rolling is important and the austenite grain diameter before the finish rolling is desirably small.

As long as the austenite grain diameter before the finish rolling is 200 μm or less, it is possible to greatly promote grain refining and homogenizing. For efficiently obtaining this promoting effect, the austenite grain diameter is desirably set to 100 μm or less. In order to achieve it, the rolling at a reduction ratio of 40% or more is desirably performed two or more times in the rough rolling process. However, when in the rough rolling process, the rolling is performed greater than 10 times, there is a concern that the temperature decreases or a scale is generated excessively.

In this manner, the austenite grain diameter before the finish rolling is decreased, which is effective for promoting the recrystallization of austenite in the finish rolling later. It is supposed that this is because an austenite grain boundary after the rough rolling (namely before the finish rolling) functions as one of recrystallization nuclei during the finish rolling.

The austenite grain diameter after the rough rolling is measured as follows. That is, the steel billet (rough bar) after the rough rolling (before being subjected to the finish rolling) is quenched as much as possible, and is desirably cooled at a cooling rate of 10° C./second or more. The structure of a cross section of the cooled steel billet is etched to make the austenite grain boundaries appear, and the austenite grain boundaries are measured by an optical microscope. On this occasion, at 50 magnifications or more, 20 visual fields or more are measured by image analysis or a point counting method.

The rough bars obtained after the completion of the rough rolling process may also be joined between the rough rolling process and a finish rolling process to then have endless rolling such that the finish rolling process is performed continuously performed thereon. On this occasion, the rough bars may also be coiled into a coil shape once, stored in a cover having a heat insulating function according to need, and uncoiled again to be joined.

On the occasion of the hot rolling process, temperature variations of the rough bar in a rolling direction, in a sheet width direction, and in a sheet thickness direction are desirably controlled to be small. In this case, according to need, a heating apparatus capable of controlling the temperature variations of the rough bar in the rolling direction, in the sheet width direction, and in the sheet thickness direction may be disposed between a roughing mill in the rough rolling process and a finishing mill in the finish rolling process, or between respective stands in the finish rolling process, and thereby the rough bar may be heated.

As a system of the heating apparatus, various heating systems such as gas heating, electrical heating, and induction heating are conceivable, but as long as the heating system makes it possible to control the temperature variations of the rough bar in the rolling direction, in the sheet width direction, and in the sheet thickness direction to be small, any one of well-known systems may also be used.

Incidentally, as the system of the heating apparatus, an induction heating system having an industrially good temperature control response is preferred. If among various induction heating systems, a plurality of transverse-type induction heating apparatuses capable of being shifted in the sheet width direction is installed, a temperature distribution in the sheet width direction can be arbitrarily controlled according to the sheet width, and thus the transverse-type induction heating apparatuses are more preferred. Further, as the system of the heating apparatus, a heating apparatus constituted by the combination of a transverse-type induction heating apparatus and a solenoid-type induction heating apparatus that excels in heating across the entire sheet width is the most preferred.

When the temperature is controlled using these heating apparatuses, it sometimes becomes necessary to control an amount of heating by the heating apparatus. In this case, the internal temperature of the rough bar cannot be measured actually, and thus previously measured actual data such as a charged slab temperature, a slab furnace existing time period, a heating furnace atmospheric temperature, a heating furnace extraction temperature, and further a table roller transfer time period are used to estimate temperature distributions in the rolling direction, in the sheet width direction, and in the sheet thickness direction when the rough bar reaches the heating apparatus, and then the amount of heating by the heating apparatus is desirably controlled.

Incidentally, the control of the amount of heating by the induction heating apparatus is controlled in the following manner, for example. A characteristic of the induction heating apparatus (transverse-type induction heating apparatus) is that when an alternating current is applied to a coil, a magnetic field is generated in its inside. In an electric conductor positioned in the magnetic field, an eddy current having an orientation opposite to the current in the coil occurs in a circumferential direction perpendicular to a magnetic flux by an electromagnetic induction effect, and by Joule heat of the eddy current, the electric conductor is heated.

The eddy current occurs most strongly on the inner surface of the coil and decreases exponentially toward the inside (this phenomenon is called a skin effect). Thus, as a frequency is smaller, a current penetration depth is increased and a heating pattern uniform in the thickness direction is obtained, and conversely, as a frequency is larger, the current penetration depth is decreased and a heating pattern that exhibits its peak at a surface layer and has small overheating is obtained in the thickness direction.

Therefore, by the transverse-type induction heating apparatus, the heating of the rough bar in the rolling direction and in the sheet width direction can be performed in a conventional manner, and further in terms of the heating in the sheet thickness direction, by changing the frequency of the transverse-type induction heating apparatus, the penetration depth is varied and the heating temperature pattern in the sheet thickness direction is controlled, to thereby make it possible to achieve uniformity of the temperature distributions. Incidentally, a frequency-changeable-type induction heating apparatus is preferably used in this case, but the frequency may also be changed by adjusting a capacitor.

With regard to the control of the amount of heating by the induction heating apparatus, a plurality of inductors having different frequencies may be disposed and an allocation of an amount of heating by each of the inductors may be changed so as to obtain the necessary heating pattern in the thickness direction. With regard to the control of the amount of heating by the induction heating apparatus, an air gap to a material to be heated is changed and thereby the frequency changes, and thus by changing the air gap, the desired frequency and heating pattern may also be obtained.

A maximum height Ry of the steel sheet surface (rough bar surface) after the finish rolling is desirably 15 μm (15 μm Ry, 12.5 mm, ln 12.5 mm) or less. This is clear because the fatigue strength of the hot-rolled or pickled steel sheet is correlated to the maximum height Ry of the steel sheet surface as is also described in Metal Material Fatigue Design Handbook, edited by The Society of Materials Science, Japan, on page 84, for example.

In order to obtain this surface roughness, a condition of an impact pressure P×a flow rate L≥0.003 of a high-pressure water onto the steel sheet surface is desirably satisfied in descaling. Further, the subsequent finish rolling is desirably performed within five seconds in order to prevent a scale from being generated again after the descaling.

(Second Hot Rolling)

After the rough rolling process (first hot rolling) is completed, the finish rolling process being second hot rolling is started. The time between the completion of the rough rolling process and the start of the finish rolling process is desirably set to 150 seconds or shorter. When the time between the completion of the rough rolling process and the start of the finish rolling process is longer than 150 seconds, the average crystal grain diameter is increased to cause the decrease in vTrs.

In the finish rolling process (second hot rolling), a finish rolling start temperature is set to 1000° C. or higher. When the finish rolling start temperature is lower than 1000° C., at each finish rolling pass, the temperature of the rolling to be applied to the rough bar to be rolled is decreased, the reduction is performed in a non-recrystallization temperature region, the texture develops, and thus the isotropy deteriorates.

Incidentally, the upper limit of the finish rolling start temperature is not limited in particular. However, when it is 1150° C. or higher, a blister to be the starting point of a scaly spindle-shaped scale defect is likely to occur between a steel sheet base iron and a surface scale before the finish rolling and between passes, and thus the finish rolling start temperature is desirably lower than 1150° C.

In the finish rolling, a temperature determined by the chemical composition of the steel sheet is set to T1, and in a temperature region of not lower than T1+30° C. nor higher than T1+200° C., the rolling at 30% or more is performed in one pass at least one time. Further, in the finish rolling, the total of the reduction ratios is set to 50% or more.

Here, T1 is the temperature calculated by Expression (1) below.

$$T1(^\circ C.)=850+10\times(C+N)\times Mn+350\times Nb+250\times Ti+40\times B+10\times Cr+100\times Mo+100\times V \quad (1)$$

C, N, Mn, Nb, Ti, B, Cr, Mo, and V each represent the content of the element (mass %).

T1 itself is obtained empirically. The present inventors learned empirically by experiments that the recrystallization in an austenite region of each steel is promoted on the basis of T1.

When the total reduction ratio in the temperature region of not lower than T1+30° C. nor higher than T1+200° C. is less than 50%, rolling strain to be accumulated during the hot rolling is not sufficient and the recrystallization of austenite does not advance sufficiently. Therefore, the texture develops and the isotropy deteriorates. When the total reduction ratio is 70% or more, the sufficient isotropy can be obtained even though variations ascribable to temperature fluctuation or the like are considered. On the other hand, when the total reduction ratio exceeds 90%, it becomes difficult to obtain the temperature region of T1+200° C. or lower due to heat generation by working, and further a rolling load increases to cause a risk that the rolling becomes difficult to be performed.

In the finish rolling, in order to promote the uniform recrystallization caused by releasing the accumulated strain, the rolling at 30% or more is performed in one pass at least one time at not lower than T1+30° C. nor higher than T1+200° C.

Incidentally, in order to promote the uniform recrystallization, it is necessary to suppress a working amount in a temperature region of lower than T1+30° C. as small as possible. In order to achieve it, the reduction ratio at lower than T1+30° C. is desirably 30% or less. In terms of sheet thickness accuracy and sheet shape, 10% or less of the reduction ratio is desirable. When the isotropy is further obtained, the reduction ratio in the temperature region of lower than T1+30° C. is desirably 0%.

The finish rolling is desirably finished at T1+30° C. or higher. In the hot rolling at lower than T1+30° C., the granulated austenite grains that are recrystallized once are elongated, thereby causing a risk that the isotropy deteriorates.

(Primary Cooling)

In the finish rolling, after the final reduction at a reduction ratio of 30% or more is performed, primary cooling is started in such a manner that a waiting time period t second satisfies Expression (2) below.

$$t \leq 2.5 \times t1 \quad (2)$$

Here, t1 is obtained by Expression (3) below.

$$t1 = 0.001 \times ((Tf - T1) \times P1/100)^2 - 0.109 \times ((Tf - T1) \times P1/100) + 3.1 \quad (3)$$

Here, in Expression (3) above, Tf represents the temperature of the steel billet obtained after the final reduction at a reduction ratio of 30% or more, and P1 represents the reduction ratio of the final reduction at 30% or more.

Incidentally, the "final reduction at a reduction ratio of 30% or more" indicates the rolling performed finally among the rollings whose reduction ratio becomes 30% or more out of the rollings in a plurality of passes performed in the finish rolling. For example, when among the rollings in a plurality of passes performed in the finish rolling, the reduction ratio of the rolling performed at the final stage is 30% or more, the rolling performed at the final stage is the "final reduction at a reduction ratio of 30% or more." Further, when among the rollings in a plurality of passes performed in the finish rolling, the reduction ratio of the rolling performed prior to the final stage is 30% or more and after the rolling performed prior to the final stage (rolling at a reduction ratio of 30% or more) is performed, the rolling whose reduction ratio becomes 30% or more is not performed, the rolling performed prior to the final stage (rolling at a reduction ratio of 30% or more) is the "final reduction at a reduction ratio of 30% or more."

In the finish rolling, the waiting time period t second until the primary cooling is started after the final reduction at a reduction ratio of 30% or more is performed greatly affects the austenite grain diameter. That is, it greatly affects an equiaxed grain fraction and a coarse grain area ratio of the steel sheet.

When the waiting time period t second exceeds t1×2.5, the recrystallization is already almost completed, but the crystal grains grow significantly and grain coarsening advances, and thereby the r value and the elongation are decreased.

The waiting time period t second further satisfies Expression (4) below, thereby making it possible to preferentially suppress the growth of the crystal grains Consequently, even though the recrystallization does not advance sufficiently, it is possible to sufficiently improve the elongation of the steel sheet and to improve the fatigue property simultaneously.

$$t < t1 \quad (4)$$

At the same time, the waiting time period t second further satisfies Expression (5) below, and thereby the recrystallization advances sufficiently and the crystal orientations are randomized. Therefore, it is possible to sufficiently improve the elongation of the steel sheet and to greatly improve the isotropy simultaneously.

$$t1 \leq t \leq t1 \times 2.5 \quad (5)$$

The waiting time period t second satisfies Expression (5) above, and thereby the average value of the pole densities of the {100}<011> to {223}<110> orientation group shown in FIG. 1 becomes 2.0 or less and the pole density of the {332}<113> crystal orientation shown in FIG. 2 becomes 3.0 or less. Consequently, the isotropic index becomes 6.0 or more and the sheet thickness uniformity and circularity that sufficiently satisfy the part property in a state where the steel sheet remains worked are achieved.

Figure 4:
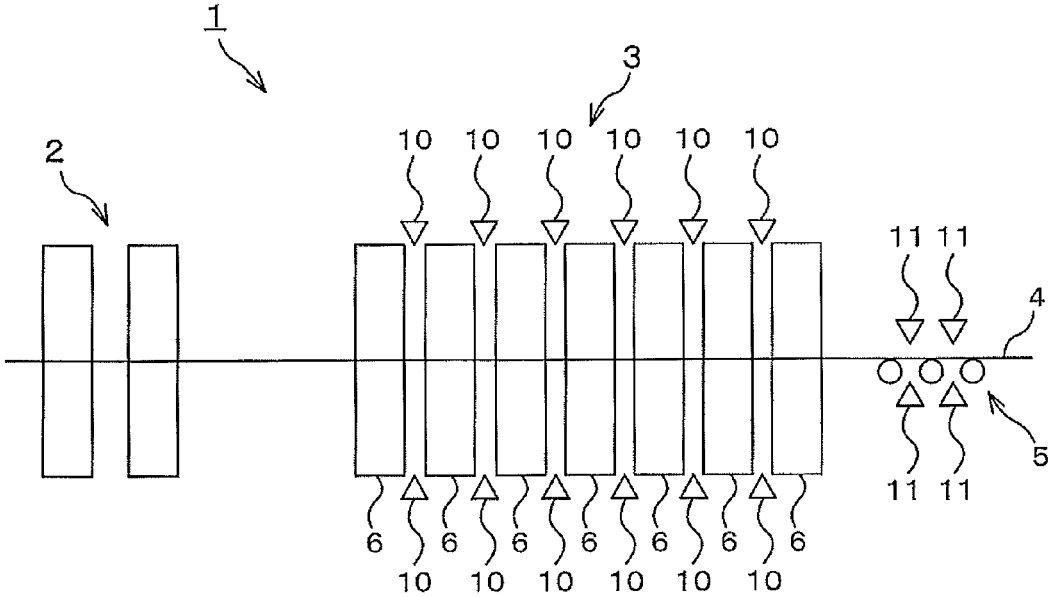
FIG. 4 is an explanatory view of a continuous hot rolling line.

Here, as shown in FIG. 4, on a continuous hot rolling line 1, the steel billet (slab) heated to a predetermined temperature in the heating furnace is rolled in a roughing mill 2 and in a finishing mill 3 sequentially to be a hot-rolled steel sheet 4 having a predetermined thickness, and the hot-rolled steel sheet 4 is carried out onto a run-out-table 5. In the present invention manufacturing method, in the rough rolling process (first hot rolling) performed in the roughing mill 2, the rolling at a reduction ratio of 40% or more is performed on the steel billet (slab) one time or more in the temperature range of not lower than 1000° C. nor higher than 1200° C.

The rough bar rolled to a predetermined thickness in the roughing mill 2 in this manner is next finish rolled (is subjected to the second hot rolling) through a plurality of rolling stands 6 of the finishing mill 3 to be the hot-rolled steel sheet 4. Then, in the finishing mill 3, the rolling at 30% or more is performed in one pass at least one time in the temperature region of not lower than the temperature T1+30° C. nor higher than T1+200° C. Further, in the finishing mill 3, the total of the reduction ratios becomes 50% or more.

Further, in the finish rolling process, after the final reduction at a reduction ratio of 30% or more is performed, the primary cooling is started in such a manner that the waiting time period t second satisfies Expression (2) above or either Expressions (4) or (5) above. The start of this primary cooling is performed by inter-stand cooling nozzles 10 disposed between the respective the rolling stands 6 of the finishing mill 3, or cooling nozzles 11 disposed in the run-out-table 5.

For example, when the final reduction at a reduction ratio of 30% or more is performed only at the rolling stand 6 disposed at the front stage of the finishing mill 3 (on the left side in FIG. 4, on the upstream side of the rolling) and the rolling whose reduction ratio becomes 30% or more is not performed at the rolling stand 6 disposed at the rear stage of the finishing mill 3 (on the right side in FIG. 4, on the downstream side of the rolling), the start of the primary cooling is performed by the cooling nozzles 11 disposed in the run-out-table 5, and thereby a case that the waiting time period t second does not satisfy Expression (2) above or Expressions (4) and (5) above is sometimes caused. In such a case, the primary cooling is started by the inter-stand cooling nozzles 10 disposed between the respective the rolling stands 6 of the finishing mill 3.

Further, for example, when the final reduction at a reduction ratio of 30% or more is performed at the rolling stand 6 disposed at the rear stage of the finishing mill 3 (on the right side in FIG. 4, on the downstream side of the rolling), even though the start of the primary cooling is performed by the cooling nozzles 11 disposed in the run-out-table 5, there is sometimes a case that the waiting time period t second can satisfy Expression (2) above or Expressions (4) and (5) above. In such a case, the primary cooling may also be started by the cooling nozzles 11 disposed in the run-out-table 5. Needless to say, as long as the performance of the final reduction at a reduction ratio of 30% or more is completed, the primary cooling may also be started by the inter-stand cooling nozzles 10 disposed between the respective the rolling stands 6 of the finishing mill 3.

Then, in this primary cooling, the cooling that at an average cooling rate of 50° C./second or more, a temperature change (temperature drop) becomes not lower than 40° C. nor higher than 140° C. is performed.

When the temperature change is lower than 40° C., the recrystallized austenite grains grow and the low-temperature toughness deteriorates. The temperature change is set to 40° C. or higher, thereby making it possible to suppress coarsening of the austenite grains. When the temperature change is lower than 40° C., the effect cannot be obtained. On the other hand, when the temperature change exceeds 140° C., the recrystallization becomes insufficient to make it difficult to obtain a targeted random texture. Further, a ferrite phase effective for the elongation is also not obtained easily and the hardness of a ferrite phase becomes high, and thereby the elongation and local ductility also deteriorate. Further, when the temperature change is higher than 140° C., an overshoot to/beyond an Ar3 transformation point temperature is likely to be caused. In the case, even by the transformation from recrystallized austenite, as a result of sharpening variant selection, the texture is formed and the isotropy decreases consequently.

When the average cooling rate in the primary cooling is less than 50° C./second, as expected, the recrystallized austenite grains grow and the low-temperature toughness deteriorates. The upper limit of the average cooling rate is not determined in particular, but in terms of the steel sheet shape, 200° C./second or less is considered to be proper.

Further, in order to suppress the grain growth and obtain the more excellent low-temperature toughness, a cooling device between passes or the like is desirably used to bring the heat generation by working between the respective stands of the finish rolling to 18° C. or lower.

A rolling ratio (the reduction ratio) can be obtained by actual performances or calculation from the rolling load, sheet thickness measurement, or/and the like. The temperature of the steel billet during the rolling can be obtained by actual measurement by a thermometer being disposed between the stands, or can be obtained by simulation by considering the heat generation by working from a line speed, the reduction ratio, or/and like, or can be obtained by the both methods.

Further, as has been explained previously, in order to promote the uniform recrystallization, the working amount in the temperature region of lower than T1+30° C. is desirably as small as possible and the reduction ratio in the temperature region of lower than T1+30° C. is desirably 30% or less. For example, in the event that in the finishing mill 3 on the continuous hot rolling line 1 shown in FIG. 4, in passing through one or two or more of the rolling stands 6 disposed on the front stage side (on the left side in FIG. 4, on the upstream side of the rolling), the steel sheet is in the temperature region of not lower than T1+30° C. nor higher than T1+200° C., and in passing through one or two or more of the rolling stands 6 disposed on the subsequent rear stage side (on the right side in FIG. 4, on the downstream side of the rolling), the steel sheet is in the temperature region of lower than T1+30° C., when the steel sheet passes through one or two or more of the rolling stands 6 disposed on the subsequent rear stage side (on the right side in FIG. 4, on the downstream side of the rolling), even though the reduction is not performed or is performed, the reduction ratio at lower than T1+30° C. is desirably 30% or less in total. In terms of the sheet thickness accuracy and the sheet shape, the reduction ratio at lower than T1+30° C. is desirably a reduction ratio of 10% or less in total. When the isotropy is further obtained, the reduction ratio in the temperature region of lower than T1+30° C. is desirably 0%.

In the present invention manufacturing method, a rolling speed is not limited in particular. However, when the rolling speed on the final stand side of the finish rolling is less than 400 mpm, γ grains grow to be coarse, regions in which ferrite can precipitate for obtaining the ductility are decreased, and thus the ductility is likely to deteriorate. Even though the upper limit of the rolling speed is not limited in particular, the effect of the present invention can be obtained, but it is actual that the rolling speed is 1800 mpm or less due to facility restriction. Therefore, in the finish rolling process, the rolling speed is desirably not less than 400 mpm nor more than 1800 mpm.

Further, within three seconds after the completion of the primary cooling, secondary cooling in which cooling is performed at an average cooling rate of 15° C./second or more is performed. When the time period to the start of the secondary cooling exceeds three seconds, pearlite transformation occurs and the targeted microstructure cannot be obtained.

When the average cooling rate of the secondary cooling is less than 15° C./second, as expected, the pearlite transformation occurs and the targeted microstructure cannot be obtained. Even though the upper limit of the average cooling rate of the secondary cooling is not limited in particular, the effect of the present invention can be obtained, but when warpage of the steel sheet due to thermal strain is considered, the average cooling rate is desirably 300° C./second or less.

The average cooling rate is not less than 15° C./second nor more than 50° C./second, which is a region allowing stable manufacturing. Further, as will be shown in examples, the region of 30° C./second or less is a region allowing more stable manufacturing.

Next, air cooling is performed for 1 to 20 seconds in a temperature region of lower than the Ar3 transformation point temperature and an Ar1 transformation point temperature or higher. This air cooling is performed in the temperature region of lower than the Ar3 transformation point temperature and the Ar1 transformation point temperature or higher (a ferrite-austenite-two-phase temperature region) in order to promote the ferrite transformation. When the air cooling is performed for less than one second, the ferrite transformation in the two-phase region is not sufficient and thus the sufficient uniform elongation cannot be obtained, and when the air cooling is performed for greater than 20 seconds, on the other hand, the pearlite transformation occurs and the targeted microstructure cannot be obtained.

The temperature region where the air cooling is performed for 1 to 20 seconds is desirably not lower than the Ar1 transformation point temperature nor higher than 860° C. in order to easily promote the ferrite transformation. A holding time period (an air cooling time period) for 1 to 20 seconds is desirably for 1 to 10 seconds in order not to decrease the productivity extremely.

The Ar3 transformation point temperature can be easily calculated by the following calculation expression (a relational expression with the chemical composition), for example. When the Si content (mass %) is set to [Si], the Cr content (mass %) is set to [Cr], the Cu content (mass %) is set to [Cu], the Mo content (mass %) is set to [Mo], and the Ni content (mass %) is set to [Ni], the Ar3 transformation point temperature can be defined by Expression (6) below.

$$Ar3=910-310\times[C]+25\times[Si]-80\times[Mneq] \quad (6)$$

When B is not added, [Mneq] is defined by Expression (7) below.

$$[Mneq]=[Mn]+[Cr]+[Cu]+[Mo]+([Ni]/2)+10([Nb]-0.02) \quad (7)$$

When B is added, [Mneq] is defined by Expression (8) below.

$$[Mneq]=[Mn]+[Cr]+[Cu]+[Mo]+([Ni]/2)+10([Nb]-0.02)+1 \quad (8)$$

Subsequently, in a coiling process, a coiling temperature is set to not lower than 450° C. nor higher than 550° C. When the coiling temperature is higher than 550° C., after the coiling, tempering in a hard phase occurs and the strength decreases. On the other hand, when the coiling temperature is lower than 450° C., during cooling after the coiling, non-transformed austenite is stabilized, and in a product steel sheet, retained austenite is contained and martensite is generated, and thereby the hole expandability decreases.

Incidentally, with the aim of achieving the improvement of the ductility by correction of the steel sheet shape and/or introduction of mobile dislocation, skin pass rolling at a reduction ratio of not less than 0.1% nor more than 2% is desirably performed after the completion of all the processes.

Further, after the completion of all the processes, pickling may also be performed with the aim of removing the scale adhering to the surface of the obtained hot-rolled steel sheet. After the pickling, on the hot-rolled steel sheet, skin pass or cold rolling at a reduction ratio of 10% or less may also be performed inline or offline.

On the present invention hot-rolled steel sheet, a heat treatment may also be performed on a hot dipping line after the casting, after the hot rolling, or after the cooling, and further on the heat-treated hot-rolled steel sheet, a surface treatment may also be performed separately. On the hot dipping line, plating is performed, and thereby the corrosion resistance of the hot-rolled steel sheet is improved.

When galvanizing is performed on the pickled hot-rolled steel sheet, after the hot-rolled steel sheet is dipped in a galvanizing bath to then be pulled up, an alloying treatment may also be performed on the hot-rolled steel sheet according to need. By performing the alloying treatment, in addition to the improvement of the corrosion resistance, welding resistance against various weldings such as spot welding is improved.

EXAMPLE

Next, examples of the present invention will be explained, but conditions of the examples are condition examples employed for confirming the applicability and effects of the present invention, and the present invention is not limited to these condition examples. The present invention can employ various conditions as long as the object of the present invention is achieved without departing from the spirit of the invention.

Example 1

Cast billets A to P having chemical compositions shown in Table 1 were each melted in a steel converter in a secondary refining process to be subjected to continuous casting and then were directly transferred or reheated to be subjected to rough rolling. In the subsequent finish rolling, they were each reduced to a sheet thickness of 2.0 to 3.6 mm and were subjected to cooling by inter-stand cooling of a finishing mill or on a run-out-table and then were coiled, and hot-rolled steel sheets were manufactured. Manufacturing conditions are shown in Table 2.

Incidentally, the balance of the chemical composition shown in Table 1 is composed of Fe and inevitable impurities, and each underline in Table 1 and Table 2 indicates that the value is outside the range of the present invention or outside the preferable range of the present invention.

TABLE 1

| | CHEMICAL COMPOSITION (UNIT: MASS %) | | | | | | | | | | | | |
|---|---|---|---|---|---|---|---|---|---|---|---|---|---|
| STEEL | C | Si | Mn | P | S | Al | N | Ti | Nb | Cu | Ni | Mo | V |
| A | 0.070 | 1.20 | 2.51 | 0.016 | 0.003 | 0.023 | 0.0026 | 0.144 | 0.020 | 0.00 | 0.00 | 0.00 | 0.00 |
| B | 0.071 | 1.17 | 2.46 | 0.011 | 0.002 | 0.029 | 0.0040 | 0.179 | 0.017 | 0.00 | 0.00 | 0.00 | 0.00 |
| C | 0.067 | 0.14 | 1.98 | 0.007 | 0.001 | 0.011 | 0.0046 | 0.091 | 0.038 | 0.00 | 0.00 | 0.00 | 0.00 |
| D | 0.036 | 0.94 | 1.34 | 0.008 | 0.001 | 0.020 | 0.0028 | 0.126 | 0.041 | 0.00 | 0.00 | 0.00 | 0.00 |
| E | 0.043 | 0.98 | 0.98 | 0.010 | 0.001 | 0.036 | 0.0034 | 0.099 | 0.000 | 0.00 | 0.00 | 0.00 | 0.00 |
| F | 0.042 | 0.73 | 1.04 | 0.011 | 0.001 | 0.024 | 0.0041 | 0.035 | 0.019 | 0.00 | 0.00 | 0.00 | 0.00 |
| G | 0.089 | 0.91 | 1.20 | 0.008 | 0.001 | 0.033 | 0.0038 | 0.000 | 0.000 | 0.00 | 0.00 | 0.00 | 0.00 |
| H | 0.180 | 0.03 | 0.72 | 0.017 | 0.004 | 0.011 | 0.0035 | 0.025 | 0.000 | 0.00 | 0.00 | 0.00 | 0.00 |
| I | 0.022 | 0.05 | 1.12 | 0.009 | 0.004 | 0.025 | 0.0047 | 0.102 | 0.000 | 0.00 | 0.00 | 0.00 | 0.00 |
| J | 0.004 | 0.12 | 1.61 | 0.080 | 0.002 | 0.041 | 0.0027 | 0.025 | 0.025 | 0.00 | 0.00 | 0.00 | 0.00 |
| K | 0.230 | 0.18 | 0.74 | 0.017 | 0.002 | 0.005 | 0.0051 | 0.000 | 0.000 | 0.00 | 0.00 | 0.00 | 0.00 |
| L | 0.091 | 0.02 | 1.50 | 0.007 | 0.001 | 0.011 | 0.0046 | 0.026 | 0.000 | 0.06 | 0.03 | 0.00 | 0.00 |
| M | 0.100 | 0.03 | 1.45 | 0.008 | 0.001 | 0.020 | 0.0028 | 0.020 | 0.000 | 0.00 | 0.03 | 0.00 | 0.00 |
| N | 0.081 | 0.01 | 1.51 | 0.010 | 0.001 | 0.036 | 0.0034 | 0.022 | 0.000 | 0.00 | 0.00 | 0.48 | 0.00 |
| O | 0.090 | 0.02 | 1.55 | 0.011 | 0.001 | 0.024 | 0.0041 | 0.024 | 0.011 | 0.00 | 0.00 | 0.00 | 0.10 |
| P | 0.087 | 0.02 | 1.52 | 0.008 | 0.001 | 0.033 | 0.0038 | 0.023 | 0.000 | 0.00 | 0.00 | 0.00 | 0.00 |
| Q | 0.084 | 0.02 | 1.49 | 0.007 | 0.001 | 0.031 | 0.0039 | 0.000 | 0.000 | 0.00 | 0.00 | 0.00 | 0.00 |

TABLE 1-continued

| STEEL | CHEMICAL COMPOSITION (UNIT: MASS %) | | | | | | NOTE |
|---|---|---|---|---|---|---|---|
| | Cr | B | Mg | Ca | Rem | OTHERS | |
| A | 0.00 | 0.0014 | 0.0022 | 0.0000 | 0.0000 | 0.0000 | PRESENT INVENTION |
| B | 0.00 | 0.0000 | 0.0000 | 0.0024 | 0.0000 | 0.0000 | PRESENT INVENTION |
| C | 0.00 | 0.0000 | 0.0019 | 0.0000 | 0.0000 | 0.0000 | COMPARATIVE STEEL |
| D | 0.00 | 0.0000 | 0.0000 | 0.0000 | 0.0000 | 0.0000 | COMPARATIVE STEEL |
| E | 0.00 | 0.0009 | 0.0000 | 0.0021 | 0.0000 | 0.0000 | COMPARATIVE STEEL |
| F | 0.00 | 0.0000 | 0.0000 | 0.0000 | 0.0018 | 0.0000 | COMPARATIVE STEEL |
| G | 0.00 | 0.0000 | 0.0000 | 0.0022 | 0.0000 | 0.0000 | PRESENT INVENTION |
| H | 0.00 | 0.0000 | 0.0000 | 0.0000 | 0.0000 | 0.0000 | PRESENT INVENTION |
| I | 0.00 | 0.0011 | 0.0000 | 0.0000 | 0.0020 | 0.0000 | COMPARATIVE STEEL |
| J | 0.00 | 0.0011 | 0.0000 | 0.0000 | 0.0020 | 0.0000 | COMPARATIVE STEEL |
| K | 0.00 | 0.0000 | 0.0000 | 0.0000 | 0.0020 | 0.0000 | COMPARATIVE STEEL |
| L | 0.00 | 0.0000 | 0.0000 | 0.0000 | 0.0000 | 0.0000 | PRESENT INVENTION |
| M | 0.00 | 0.0000 | 0.0000 | 0.0000 | 0.0000 | 0.0000 | PRESENT INVENTION |
| N | 0.00 | 0.0010 | 0.0000 | 0.0000 | 0.0000 | 0.0000 | PRESENT INVENTION |
| O | 0.00 | 0.0000 | 0.0000 | 0.0000 | 0.0000 | 0.0000 | PRESENT INVENTION |
| P | 0.91 | 0.0000 | 0.0000 | 0.0000 | 0.0000 | 0.0000 | PRESENT INVENTION |
| Q | 0.00 | 0.0015 | 0.0000 | 0.0000 | 0.0000 | 0.0000 | PRESENT INVENTION |

TABLE 2

| | | | | | MANUFACTURING CONDITIONS | | | | | | | | |
|---|---|---|---|---|---|---|---|---|---|---|---|---|---|
| | | METALLURGICAL FACTORS | | | HEATING TEMPERATURE CONDITIONS | | ROUGH ROLLING CONDITIONS | | | FINISH ROLLING CONDITIONS | | | |
| | STEEL NUMBER | COM-PONENT | Ar3 TRANSPORMA-TION POINT TEMPERATURE (° C.) | T1 (° C.) | HEATING TEMPER-ATURE (° C.) | HOLD-ING TIME PERIOD (min) | NUMBER OF TIMES OF REDUCTION AT 100° C. OR HIGHER AT 40% OR MORE | REDUCTION RATIO AT 100° C. OR HIGHER | TIME PERIOD TO START OF FINISH ROLLING (sec) | TOTAL RE-DUCTION RATIO (%) | Tf (° C.) | P1 (%) | MAXIMUM WORKING HEAT GENERATION TEMPERATURE (° C.) |
| PRESENT INVENTION | 1 | A | 859 | 895 | 1260 | 45 | 2 | 45/45 | 60 | 90 | 990 | 40 | 15 |
| PRESENT INVENTION | 2 | B | 723 | 903 | 1260 | 45 | 2 | 45/45 | 60 | 90 | 990 | 40 | 12 |
| COMPARATIVE EXAMPLE | 3 | C | 720 | 887 | 1230 | 45 | 3 | 40/40/40 | 60 | 93 | 980 | 35 | 15 |
| COMPARATIVE EXAMPLE | 4 | D | 798 | 896 | 1200 | 60 | 3 | 40/40/40 | 90 | 89 | 990 | 32 | 12 |
| COMPARATIVE EXAMPLE | 5 | E | 779 | 875 | 1200 | 60 | 3 | 40/40/40 | 90 | 89 | 970 | 32 | 12 |
| COMPARATIVE EXAMPLE | 6 | F | 833 | 866 | 1200 | 60 | 3 | 40/40/40 | 90 | 89 | 960 | 32 | 12 |
| PRESENT INVENTION | 7 | G | 825 | 851 | 1200 | 60 | 3 | 40/40/40 | 90 | 89 | 950 | 32 | 12 |
| COMPARATIVE EXAMPLE | 8 | G | 825 | 851 | 1200 | 60 | 0 | 25/25/25 | 90 | 89 | 950 | 32 | 12 |
| PRESENT INVENTION | 9 | G | 825 | 851 | 1200 | 60 | 3 | 40/40/40 | 180 | 89 | 950 | 32 | 12 |
| COMPARATIVE EXAMPLE | 10 | G | 825 | 851 | 1200 | 60 | 3 | 40/40/40 | 90 | 45 | 950 | 32 | 12 |
| COMPARATIVE EXAMPLE | 11 | G | 825 | 851 | 1200 | 60 | 3 | 40/40/40 | 90 | 89 | 850 | 32 | 12 |
| COMPARATIVE EXAMPLE | 12 | G | 825 | 851 | 1200 | 60 | 3 | 40/40/40 | 90 | 89 | 1050 | 32 | 12 |
| COMPARATIVE EXAMPLE | 13 | G | 825 | 851 | 1200 | 60 | 3 | 40/40/40 | 90 | 89 | 950 | 29 | 12 |
| COMPARATIVE EXAMPLE | 14 | G | 825 | 851 | 1200 | 60 | 3 | 40/40/40 | 90 | 89 | 950 | 32 | 25 |
| COMPARATIVE EXAMPLE | 15 | G | 825 | 851 | 1200 | 60 | 3 | 40/40/40 | 90 | 89 | 950 | 32 | 12 |
| COMPARATIVE EXAMPLE | 16 | G | 825 | 851 | 1200 | 60 | 3 | 40/40/40 | 90 | 89 | 950 | 32 | 12 |
| COMPARATIVE EXAMPLE | 17 | G | 825 | 851 | 1200 | 60 | 3 | 40/40/40 | 90 | 89 | 950 | 32 | 12 |

TABLE 2-continued

| | | | | | | | | | | | | | |
|---|---|---|---|---|---|---|---|---|---|---|---|---|---|
| COMPARATIVE EXAMPLE | 18 | G | 825 | 851 | 1200 | 60 | 3 | 40/40/40 | 90 | 89 | 950 | 32 | 12 |
| COMPARATIVE EXAMPLE | 19 | G | 825 | 851 | 1200 | 60 | 3 | 40/40/40 | 90 | 89 | 950 | 32 | 12 |
| COMPARATIVE EXAMPLE | 20 | G | 825 | 851 | 1200 | 60 | 3 | 40/40/40 | 90 | 89 | 950 | 32 | 12 |
| COMPARATIVE EXAMPLE | 21 | G | 825 | 851 | 1200 | 60 | 3 | 40/40/40 | 90 | 89 | 950 | 32 | 12 |
| COMPARATIVE EXAMPLE | 22 | G | 825 | 851 | 1200 | 60 | 3 | 40/40/40 | 90 | 89 | 950 | 32 | 12 |
| COMPARATIVE EXAMPLE | 23 | G | 825 | 851 | 1200 | 60 | 3 | 40/40/40 | 90 | 89 | 950 | 32 | 12 |
| COMPARATIVE EXAMPLE | 24 | G | 825 | 851 | 1200 | 60 | 3 | 40/40/40 | 90 | 89 | 950 | 32 | 12 |
| COMPARATIVE EXAMPLE | 25 | G | 825 | 851 | 1200 | 60 | 3 | 40/40/40 | 90 | 89 | 950 | 32 | 12 |
| COMPARATIVE EXAMPLE | 26 | G | 825 | 851 | 1200 | 60 | 3 | 40/40/40 | 90 | 89 | 950 | 32 | 12 |
| PRESENT INVENTION | 27 | H | 813 | 858 | 1200 | 60 | 1 | 50 | 90 | 89 | 980 | 35 | 15 |
| COMPARATIVE EXAMPLE | 28 | I | 751 | 876 | 1200 | 60 | 3 | 40/40/40 | 90 | 89 | 960 | 32 | 12 |
| COMPARATIVE EXAMPLE | 29 | J | 699 | 865 | 1200 | 60 | 3 | 40/40/40 | 90 | 89 | 950 | 32 | 12 |
| COMPARATIVE EXAMPLE | 30 | K | 800 | 852 | 1200 | 60 | 3 | 40/40/40 | 90 | 89 | 940 | 32 | 12 |
| PRESENT INVENTION | 31 | L | 772 | 858 | 1180 | 90 | 3 | 40/40/40 | 90 | 89 | 960 | 32 | 12 |
| PRESENT INVENTION | 32 | M | 779 | 856 | 1180 | 90 | 3 | 40/40/40 | 90 | 89 | 950 | 32 | 12 |
| PRESENT INVENTION | 33 | N | 662 | 905 | 1180 | 90 | 3 | 40/40/40 | 90 | 89 | 940 | 32 | 12 |
| PRESENT INVENTION | 34 | O | 766 | 871 | 1180 | 90 | 3 | 40/40/40 | 90 | 89 | 950 | 32 | 12 |
| PRESENT INVENTION | 35 | P | 705 | 866 | 1180 | 90 | 3 | 40/40/40 | 90 | 89 | 940 | 32 | 12 |
| PRESENT INVENTION | 36 | Q | 701 | 851 | 1180 | 90 | 3 | 40/40/40 | 90 | 89 | 940 | 32 | 12 |

| | | MANUFACTURING CONDITIONS COOLING CONDITIONS | | | | | | | | | | | |
|---|---|---|---|---|---|---|---|---|---|---|---|---|---|
| | STEEL NUMBER | t1 (sec) | 1 × 25 | TIME PERIOD TO START OF PRIMARY COOLING (sec) | t/t1 | PRIMARY COOLING RATE (° C./sec) | PRIMARY COOLING TEMPERATURE CHANGE (° C.) | TIME PERIOD TO START OF SBCONDARY COOLING (sec) | SECONDARY COOLING RATE (° C./sec) | AIR COOLING TEMPERATURE REGION (° C.) | AIR COOLING HOLDING TIME PERIOD (sec) | COILING TEMPERATURE (° C.) |
| PRESENT INVENTION | 1 | 0.40 | 1.00 | 1.0 | 2.5 | 135 | 90 | 1.5 | 30 | 660 | 2 | 470 |

TABLE 2-continued

| | | | | | | | | | | | | |
|---|---|---|---|---|---|---|---|---|---|---|---|---|
| PRESENT INVENTION | 2 | 0.51 | 1.28 | 1.0 | 2.0 | 60 | 90 | 2.5 | 30 | 660 | 8 | 470 |
| COMPARATIVE EXAMPLE | 3 | 0.62 | 1.55 | 0.8 | 1.3 | 65 | 110 | 1.0 | 40 | 680 | 5 | 470 |
| COMPARATIVE EXAMPLE | 4 | 0.73 | 1.83 | 0.9 | 1.2 | 60 | 70 | 1.6 | 25 | 680 | 5 | 470 |
| COMPARATIVE EXAMPLE | 5 | 0.71 | 1.79 | 0.9 | 1.3 | 60 | 70 | 1.6 | 25 | 670 | 2 | 470 |
| COMPARATIVE EXAMPLE | 6 | 0.72 | 1.81 | 0.9 | 1.2 | 60 | 70 | 1.6 | 25 | 690 | 2 | 470 |
| PRESENT INVENTION | 7 | 0.65 | 1.63 | 0.9 | 1.4 | 45 | 70 | 1.6 | 25 | 700 | 4 | 500 |
| COMPARATIVE EXAMPLE | 8 | 0.65 | 1.63 | 0.9 | 1.4 | 60 | 70 | 1.6 | 25 | 700 | 4 | 500 |
| PRESENT INVENTION | 9 | 0.65 | 1.63 | 0.9 | 1.4 | 60 | 70 | 1.6 | 25 | 700 | 4 | 500 |
| COMPARATIVE EXAMPLE | 10 | 0.65 | 1.63 | 0.9 | 1.4 | 60 | 70 | 1.6 | 25 | 700 | 4 | 500 |
| COMPARATIVE EXAMPLE | 11 | 3.14 | 7.85 | 0.9 | 0.3 | 60 | 70 | 1.6 | 25 | 700 | 4 | 500 |
| COMPARATIVE EXAMPLE | 12 | 0.21 | 0.53 | 0.9 | 4.2 | 60 | 70 | 1.6 | 25 | 700 | 4 | 500 |
| COMPARATIVE EXAMPLE | 13 | — | — | 0.9 | — | 60 | 70 | 1.6 | 25 | 700 | 4 | 500 |
| COMPARATIVE EXAMPLE | 14 | 0.65 | 1.63 | 0.9 | 1.4 | 60 | 70 | 1.6 | 25 | 700 | 4 | 500 |
| COMPARATIVE EXAMPLE | 15 | 0.65 | 1.63 | 2.0 | 3.1 | 60 | 70 | 1.6 | 25 | 700 | 4 | 500 |
| COMPARATIVE EXAMPLE | 16 | 0.65 | 1.63 | 0.9 | 1.4 | 5 | 70 | 1.6 | 25 | 700 | 4 | 500 |
| COMPARATIVE EXAMPLE | 17 | 0.65 | 1.63 | 0.9 | 1.4 | 60 | 20 | 1.6 | 25 | 700 | 4 | 500 |
| COMPARATIVE EXAMPLE | 18 | 0.65 | 1.63 | 0.9 | 1.4 | 60 | 200 | 1.6 | 25 | 700 | 4 | 500 |
| COMPARATIVE EXAMPLE | 19 | 0.65 | 1.63 | 0.9 | 1.4 | 60 | 70 | 10.0 | 25 | 700 | 4 | 500 |
| COMPARATIVE EXAMPLE | 20 | 0.65 | 1.63 | 0.9 | 1.4 | 60 | 70 | 1.6 | 5 | 700 | 4 | 500 |
| COMPARATIVE EXAMPLE | 21 | 0.65 | 1.63 | 0.9 | 1.4 | 60 | 70 | 1.6 | 25 | 840 | 4 | 500 |
| COMPARATIVE EXAMPLE | 22 | 0.65 | 1.63 | 0.9 | 1.4 | 60 | 70 | 1.6 | 25 | 580 | 4 | 500 |
| COMPARATIVE EXAMPLE | 23 | 0.65 | 1.63 | 0.9 | 1.4 | 60 | 70 | 1.6 | 25 | — | — | 500 |
| COMPARATIVE EXAMPLE | 24 | 0.65 | 1.63 | 0.9 | 1.4 | 60 | 70 | 1.6 | 25 | 700 | 28 | 500 |
| COMPARATIVE EXAMPLE | 25 | 0.65 | 1.63 | 0.9 | 1.4 | 60 | 70 | 1.6 | 25 | 700 | 4 | 100 |

TABLE 2-continued

| | | | | | | | | | | | | |
|---|---|---|---|---|---|---|---|---|---|---|---|---|
| COMPARATIVE EXAMPLE | 26 | 0.65 | 1.63 | 0.9 | 1.4 | 60 | 70 | 1.6 | 25 | 700 | 4 | 650 |
| PRESENT INVENTION | 27 | 0.27 | 0.66 | 0.6 | 2.3 | 65 | 110 | 1.0 | 20 | 670 | 2 | 530 |
| COMPARATIVE EXAMPLE | 28 | 0.89 | 2.22 | 0.9 | 1.0 | 60 | 70 | 1.0 | 20 | 670 | 2 | 530 |
| COMPARATIVE EXAMPLE | 29 | 0.88 | 2.19 | 0.9 | 1.0 | 60 | 70 | 1.0 | 20 | 670 | 2 | 530 |
| COMPARATIVE EXAMPLE | 30 | 0.82 | 2.05 | 0.9 | 1.1 | 60 | 70 | 1.0 | 20 | 670 | 2 | 530 |
| PRESENT INVENTION | 31 | 0.61 | 1.52 | 0.9 | 1.5 | 60 | 70 | 1.0 | 20 | 670 | 10 | 470 |
| PRESENT INVENTION | 32 | 0.73 | 1.83 | 0.9 | 1.2 | 60 | 70 | 1.0 | 20 | 670 | 10 | 470 |
| PRESENT INVENTION | 33 | 2.00 | 5.00 | 0.9 | 0.5 | 60 | 70 | 1.0 | 20 | 670 | 10 | 470 |
| PRESENT INVENTION | 34 | 0.99 | 2.47 | 0.9 | 0.9 | 60 | 70 | 1.0 | 20 | 670 | 10 | 470 |
| PRESENT INVENTION | 35 | 1.08 | 2.71 | 0.9 | 0.8 | 60 | 70 | 1.0 | 20 | 670 | 10 | 470 |
| PRESENT INVENTION | 36 | 0.81 | 2.03 | 0.7 | 0.9 | 60 | 70 | 1.0 | 20 | 670 | 10 | 470 |

In Table 2, "COMPONENT" means the symbol of steel shown in Table 1. "Ar3 TRANSFORMATION POINT TEMPERATURE" is the temperature calculated by Expressions (6), (7), and (8) above. "T1" indicates the temperature calculated by Expression (1) above. "t1" indicates the temperature calculated by Expression (2) above.

"HEATING TEMPERATURE" is the heating temperature in the heating process. "HOLDING TIME PERIOD" is the holding time period at a predetermined heating temperature in the heating process.

from the completion of the secondary cooling to the coiling. "AIR COOLING HOLDING TIME PERIOD" is the holding time period when the holding (air cooling) is performed. "COILING TEMPERATURE" is the temperature at which the steel sheet is coiled by a coiler in the coiling process.

Further, with regard to the present invention example of Steel number 7 and the comparative examples of Steel numbers 13 and 10, the relationship between, of the finish rolling, the reduction ratio of each of rolling stands F1 to F7 and the temperature region is shown in Table 4.

TABLE 3

| | F1 | F2 | F3 | F4 | F5 | F6 | F7 | TOTAL REDUCTION RATIO AT T1 + 30° C. OR HIGHER |
|---|---|---|---|---|---|---|---|---|
| PRESENT INVENTION | 38.9 | 37.8 | 37.4 | 34.7 | 31.9 | 0.0 | 0.0 | 89 |
| COMPARATIVE EXAMPLE | 29.0 | 28.8 | 28.8 | 27.5 | 26.6 | 25.9 | 25.6 | 89 |
| COMPARATIVE EXAMPLE | 0.0 | 19.1 | 32.4 | 32.3 | 32.1 | 34.2 | 36.0 | 45 |

"NUMBER OF TIMES OF REDUCTION AT 1000° C. OR HIGHER AT 40% OR MORE" is the number of times of reduction at a reduction ratio of 40% or more in the temperature range of not lower than 1000° C. nor higher than 1200° C. in the rough rolling. "REDUCTION RATIO AT 1000° C. OR HIGHER" is each reduction ratio (reduction pass schedule) in the temperature range of not lower than 1000° C. nor higher than 1200° C. in the rough rolling. It is indicated that in a present invention example (Steel number 1), for example, the reduction at a reduction ratio of 45% was performed two times. Further, it is indicated that in a comparative example (Steel number 3), for example, the reduction at a reduction ratio of 40% was performed three times. "TIME PERIOD TO START OF FINISH ROLLING" is the time period from the completion of the rough rolling process to the start of the finish rolling process. "TOTAL REDUCTION RATIO" is the total reduction ratio in the finish rolling process.

"Tf" indicates the temperature after the final reduction at 30% or more in the finish rolling "P1" indicates the reduction ratio of the final reduction at 30% or more in the finish rolling. However, in the comparative example (Steel number 13), the largest value among the reduction ratios of the respective rolling stands 6 in the finish rolling was 29%. In the comparative example (Steel number 13), the temperature after the reduction at this reduction ratio of 29% was set to "Tf." "MAXIMUM WORKING HEAT GENERATION" is the maximum temperature increased by the heat generation by working between respective finishing passes (between the respective rolling stands 6).

"TIME PERIOD TO START OF PRIMARY COOLING" is the time period from after the completion of the final reduction at 30% or more in the finish rolling to the start of the primary cooling. "PRIMARY COOLING RATE" is the average cooling rate to which the cooling corresponding to the amount of the primary cooling temperature change is completed. "PRIMARY COOLING TEMPERATURE CHANGE" is the difference between, of the primary cooling, the start temperature and the finishing temperature.

"TIME PERIOD TO START OF SECONDARY COOLING" is the time period from the completion of the primary cooling to the start of the secondary cooling. "SECONDARY COOLING RATE" is the average cooling rate from the start of the secondary cooling to the coiling, from which the holding time period (air cooling time period) is removed. "AIR COOLING TEMPERATURE REGION" is the temperature region where the holding (air cooling) is performed In the present invention example of Steel number 7, the steel sheet was in the temperature region of not lower than T1+30° C. nor higher than T1+200° C. at the rolling stands F1 to F5, and was in the temperature region of lower than T1+30° C. at and after the rolling stand F6. In the present invention example of Steel number 7, at the rolling stands F1 to F5, the reduction at a reduction ratio of 30% or more was performed five times in the temperature region of not lower than T1+30° C. nor higher than T1+200° C., and after the rolling stand F6, no reduction was performed practically in the temperature region of lower than T1+30° C. The steel sheet was just passed through the rolling stands F6 and F7. As was shown also in Table 2, in the present invention example of Steel number 7, the total reduction ratio in the temperature region of not lower than T1+30° C. nor higher than T1+200° C. is 89%.

Incidentally, the reduction ratio at each of the rolling stands F1 to F7 is obtained by the change in sheet thickness between the entry side and the exist side of each of the rolling stands F1 to F7. In contrast to this, the total reduction ratio in the temperature region of not lower than T1+30° C. nor higher than T1+200° C. is obtained by the change in sheet thickness before and after all the rolling passes performed in the temperature region in the finish rolling. As shown in the present invention example of Steel number 7, for example, the total reduction ratio in the temperature region is obtained by the change in sheet thickness before and after all the rolling passes performed at the rolling stands F1 to F5. That is, it is obtained by the change between the sheet thickness on the entry side of the rolling stand F1 and the sheet thickness on the exist side of the rolling stand F5.

On the other hand, in the comparative example of Steel number 13, the steel sheet was in the temperature region of not lower than T1+30° C. nor higher than T1+200° C. at all the rolling stands F1 to F7 in the finish rolling. As was shown also in Table 2, in the comparative example of steel number 13, the total reduction ratio in the temperature region of not lower than T1+30° C. nor higher than T1+200° C. is 89%. However, in the comparative example of Steel number 13, at each of the rolling stands F1 to F7, the reduction at a reduction ratio of 30% or more is not performed.

Further, in the comparative example of Steel number 10, the steel sheet was in the temperature region of not lower than T1+30° C. nor higher than T1+200° C. at the rolling stands F1 to F3, and the steel sheet was in the temperature region of lower than T1+30° C. at and after the rolling stand F4. In the comparative example of Steel number 10, at the rolling stands F1 to F3, the reduction at a reduction ratio of 30% or more was performed three times in the temperature region of not lower than T1+30° C. nor higher than T1+200° C., and further also in the temperature region of lower than T1+30° C. at and after the rolling stand F4, the reduction at a reduction ratio of 30% or more was performed four times.

As was shown also in Table 2, in the comparative example of steel number 10, the total reduction ratio in the temperature region of not lower than T1+30° C. nor higher than T1+200° C. is 45%.

The evaluation methods of the obtained hot-rolled steel sheet are the same as the previously described methods. Evaluation results are shown in Table 3.

TABLE 4

| | | MICROSTRUCTURE | | | |
|---|---|---|---|---|---|
| | STEEL NUMBER | STRUCTURAL FRACTION | AVERAGE CRYSTAL GRAIN DIAMETER (μm) | AVERAGE VALUE OF POLE DENSITIES OF [100]<011> TO [223]<110> ORIENTATION GROUP | POLE DENSITY OF [332]<113> CRYSTAL ORIENTATION |
| PRESENT INVENTION | 1 | Zw + 8% F | 7.5 | 1.7 | 2.5 |
| PRESENT INVENTION | 2 | Zw + 6% F | 8.0 | 1.7 | 2.5 |
| COMPARATIVE EXAMPLE | 3 | Zw | 8.0 | 1.8 | 2.6 |
| COMPARATIVE EXAMPLE | 4 | Zw | 7.0 | 1.7 | 2.5 |
| COMPARATIVE EXAMPLE | 5 | Zw | 9.0 | 2.0 | 2.9 |
| COMPARATIVE EXAMPLE | 6 | Zw + 36%F | 8.0 | 2.0 | 2.9 |
| PRESENT INVENTION | 7 | Zw + 32% F | 9.5 | 2.0 | 2.9 |
| COMPARATIVE EXAMPLE | 8 | Zw + 28% F | 10.5 | 1.7 | 2.5 |
| PRESENT INVENTION | 9 | Zw + 30% F | 10.0 | 3.1 | 4.2 |
| COMPARATIVE EXAMPLE | 10 | Zw + 34% F | 7.0 | 4.2 | 5.0 |
| COMPARATIVE EXAMPLE | 11 | Zw + 33% F | 4.5 | 5.1 | 5.5 |
| COMPARATIVE EXAMPLE | 12 | Zw + 26% F | 11.0 | 1.7 | 2.5 |
| COMPARATIVE EXAMPLE | 13 | Zw + 31% F | 6.5 | 5.3 | 5.6 |
| COMPARATIVE EXAMPLE | 14 | Zw + 35% F | 10.5 | 1.7 | 2.5 |
| COMPARATIVE EXAMPLE | 15 | Zw + 34% F | 12.0 | 1.7 | 2.5 |
| COMPARATIVE EXAMPLE | 16 | Zw + 33% F | 11.5 | 1.8 | 2.6 |
| COMPARATIVE EXAMPLE | 17 | Zw + 34% F | 10.5 | 1.8 | 2.6 |
| COMPARATIVE EXAMPLE | 18 | Zw + 33% F | 6.5 | 5.4 | 5.7 |
| COMPARATIVE EXAMPLE | 19 | P + 44% F | 8.5 | 1.9 | 2.8 |
| COMPARATIVE EXAMPLE | 20 | P + 38% F | 8.0 | 2.0 | 2.9 |
| COMPARATIVE EXAMPLE | 21 | P + 45% F | 8.5 | 2.0 | 2.9 |
| COMPARATIVE EXAMPLE | 22 | Zw | 8.0 | 2.0 | 2.9 |
| COMPARATIVE EXAMPLE | 23 | Zw | 8.5 | 2.0 | 2.9 |
| COMPARATIVE EXAMPLE | 24 | P + 47% F | 8.5 | 2.0 | 2.9 |
| COMPARATIVE EXAMPLE | 25 | 56% F + M | 8.5 | 2.0 | 2.9 |
| COMPARATIVE EXAMPLE | 26 | P + 37% F | 8.5 | 2.0 | 2.9 |
| PRESENT INVENTION | 27 | Zw + 15% F | 8.0 | 1.8 | 2.6 |
| COMPARATIVE EXAMPLE | 28 | 67% F + Zw | 8.5 | 2.0 | 2.9 |
| COMPARATIVE EXAMPLE | 29 | E | 11.0 | 2.0 | 2.9 |
| COMPARATIVE EXAMPLE | 30 | Zw | 9.5 | 2.6 | 3.7 |
| PRESENT INVENTION | 31 | Zw + 8% F | 6.5 | 2.0 | 2.9 |
| PRESENT INVENTION | 32 | Zw + 11% F | 7.5 | 1.9 | 2.8 |
| PRESENT INVENTION | 33 | Zw + 9% F | 6.0 | 3.9 | 2.8 |
| PRESENT INVENTION | 34 | Zw + 17% F | 4.0 | 3.6 | 2.6 |
| PRESENT INVENTION | 35 | Zw + 14% F | 6.5 | 3.7 | 2.6 |
| PRESENT INVENTION | 36 | Zw + 14% F | 6.5 | 3.3 | 2.8 |

| | | MECHANICAL PROPERTIES | | | | | | |
|---|---|---|---|---|---|---|---|---|
| | | TENSILE TEST | | | | HOLE EXPANSION | BENDABILITY | TOUGHNESS |
| | STEEL NUMBER | YP (MPa) | TS (MPa) | El (%) | ISOTROPY 1/l⊿ rl | λ (%) | MINIMUM BEND RADIUS | √Trs (° C.) |
| PRESENT INVENTION | 1 | 906 | 998 | 15 | 12.5 | 71 | 0.6 | −58 |
| PRESENT INVENTION | 2 | 857 | 1015 | 14 | 12.5 | 75 | 0.5 | −48 |
| COMPARATIVE EXAMPLE | 3 | 677 | 744 | 11 | 9.2 | 71 | 0.6 | −48 |
| COMPARATIVE EXAMPLE | 4 | 700 | 761 | 10 | 12.5 | 70 | 0.8 | −68 |
| COMPARATIVE EXAMPLE | 5 | 716 | 770 | 9 | 6.5 | 70 | 0.8 | −31 |
| COMPARATIVE EXAMPLE | 6 | 412 | 588 | 28 | 6.5 | 68 | 1.1 | −48 |
| PRESENT INVENTION | 7 | 475 | 577 | 30 | 6.5 | 131 | 0.2 | −25 |
| COMPARATIVE EXAMPLE | 8 | 484 | 580 | 28 | 12.5 | 125 | 0.1 | −11 |
| PRESENT INVENTION | 9 | 490 | 588 | 27 | 3.8 | 123 | 0.1 | −20 |
| COMPARATIVE EXAMPLE | 10 | 482 | 581 | 28 | 3.2 | 88 | 0.2 | −68 |
| COMPARATIVE EXAMPLE | 11 | 475 | 575 | 28 | 3.1 | 87 | 0.2 | −125 |
| COMPARATIVE EXAMPLE | 12 | 458 | 560 | 29 | 12.5 | 132 | 0.1 | −5 |
| COMPARATIVE EXAMPLE | 13 | 477 | 577 | 28 | 3.0 | 85 | 0.1 | −80 |
| COMPARATIVE EXAMPLE | 14 | 480 | 571 | 28 | 12.5 | 136 | 0.2 | −17 |
| COMPARATIVE EXAMPLE | 15 | 478 | 585 | 26 | 12.5 | 135 | 0.2 | 6 |
| COMPARATIVE EXAMPLE | 16 | 481 | 579 | 27 | 9.2 | 130 | 0.1 | 0 |
| COMPARATIVE EXAMPLE | 17 | 471 | 577 | 27 | 9.2 | 133 | 0.2 | −17 |
| COMPARATIVE EXAMPLE | 18 | 468 | 566 | 28 | 3.0 | 89 | 0.2 | −80 |

TABLE 4-continued

| | | | | | | | | |
|---|---|---|---|---|---|---|---|---|
| COMPARATIVE EXAMPLE | 19 | 420 | 521 | 24 | 7.5 | 67 | 1.4 | −40 |
| COMPARATIVE EXAMPLE | 20 | 418 | 520 | 25 | 6.5 | 65 | 1.7 | −48 |
| COMPARATIVE EXAMPLE | 21 | 409 | 510 | 26 | 6.5 | 66 | 1.8 | −40 |
| COMPARATIVE EXAMPLE | 22 | 581 | 644 | 15 | 6.5 | 76 | 0.9 | −48 |
| COMPARATIVE EXAMPLE | 23 | 601 | 650 | 14 | 6.5 | 75 | 0.8 | −40 |
| COMPARATIVE EXAMPLE | 24 | 390 | 495 | 27 | 6.5 | 69 | 1.6 | −40 |
| COMPARATIVE EXAMPLE | 25 | 370 | 622 | 28 | 6.5 | 41 | 2.1 | −40 |
| COMPARATIVE EXAMPLE | 26 | 400 | 503 | 26 | 6.5 | 69 | 1.8 | −40 |
| PRESENT INVENTION | 27 | 548 | 655 | 26 | 9.2 | 141 | 0.1 | −48 |
| COMPARATIVE EXAMPLE | 28 | 396 | 522 | 30 | 6.5 | 122 | 1.1 | −40 |
| COMPARATIVE EXAMPLE | 29 | 355 | 462 | 35 | 6.5 | 140 | 0.1 | −5 |
| COMPARATIVE EXAMPLE | 30 | 986 | 1126 | 5 | 4.3 | 22 | 0.8 | −24 |
| PRESENT INVENTION | 31 | 588 | 711 | 24 | 6.5 | 105 | 0.1 | −80 |
| PRESENT INVENTION | 32 | 570 | 702 | 25 | 7.5 | 97 | 0.08 | −58 |
| PRESENT INVENTION | 33 | 592 | 720 | 24 | 4.8 | 101 | 0.1 | −93 |
| PRESENT INVENTION | 34 | 585 | 700 | 25 | 4.6 | 96 | 0.07 | −127 |
| PRESENT INVENTION | 35 | 578 | 695 | 25 | 4.7 | 93 | 0.1 | −80 |
| PRESENT INVENTION | 36 | 603 | 732 | 23 | 4.3 | 91 | 0.1 | −80 |

"STRUCTURAL FRACTION" is the area fraction of each structure measured by a point counting method from an optical microscope structure. "AVERAGE CRYSTAL GRAIN DIAMETER" is the average crystal grain diameter measured by the EBSP-OIM™.

"AVERAGE VALUE OF X-RAY RANDOM INTENSITIES OF {100}<011> TO {223}<110> ORIENTATION GROUP" is the pole density of the {100}<011> to {223}<110> orientation group parallel to the rolled plane. "POLE DENSITY OF {332}<113> CRYSTAL ORIENTATION" is the pole density of the {332}<113> crystal orientation parallel to the rolled plane.

"TENSILE TEST" indicates the result obtained after a tensile test being performed on a C-direction JIS No. 5 test piece. "YP" indicates the yield point, "TS" indicates the tensile strength, and "EL" indicates the elongation.

"ISOTROPY" indicates the inverse number of $|\Delta r|$ as an index.

"HOLE EXPANSION λ" indicates the result obtained by the hole expanding test method described in JFS T 1001-1996. "BENDABILITY (MINIMUM BEND RADIUS)" indicates the result obtained by performing a test using a No. 1 test piece (t×40 mm W×80 mm L), at a pressing jig speed of 0.1 m/second, in accordance with the pressing bend method (roller bend method) described in JIS Z 2248. YP≥320 MPa, Ts≥540 MPa, E≥18%, λ≥70%, and the minimum bend radius ≤1 mm were accepted.

Incidentally, a length L between supporting points is L=2r+3t, where the sheet thickness is set to t (mm) and the inside radius of a tip of the pressing jig is set to r (mm).

In this method, a bending angle was set up to 170°, and thereafter an interposed object having a thickness twice as large as the radius of the pressing jig was used, the test piece was pressed against the interposed object to be wound therearound, and with a bending angle of 180°, cracking in the outside of a bent portion was observed visually.

"MINIMUM BEND RADIUS" is one that the test is performed by decreasing the inside radius r (mm) until cracking occurs and the minimum inside radius r (mm) that does not cause cracking is divided by the sheet thickness t (mm) to be made dimensionless by r/t. "MINIMUM BEND RADIUS" becomes the smallest in the case of close-contact bending that is performed without the interposed object, and in the case, "MINIMUM BEND RADIUS" is zero. Incidentally, a bending direction was set at 45° from the rolling direction. "TOUGHNESS" is indicated by the transition temperature obtained by a subsize V-notch Charpy test.

The invention examples correspond to the nine examples of Steel numbers 1, 2, 7, 27, and 31 to 35. In these invention examples of Steel numbers, the high-strength steel sheet in which the texture of the steel sheet having a required chemical composition is obtained, the average value of the pole densities of the {100}<011> to {223}<110> orientation group of the sheet plane at a sheet thickness of ⅝ to ⅜ from the surface of the steel sheet is at least 4.0 or less, the pole density of the {332}<113> crystal orientation is 4.8 or less, and the average crystal grain diameter at the sheet thickness center is 9 μm or less, the microstructure is composed of pro-eutectoid ferrite in a structural fraction of 35% or less at the sheet thickness center and the low-temperature transformation generating phase, and the tensile strength is 540 MPa class or more is obtained.

The comparative examples of the steel sheet other than the above-described examples each fall outside the range of the present invention due to the following reasons.

With regard to Steel numbers 3 to 5, the C content is outside the range of the present invention, and thus the microstructure is outside the range of the present invention and the elongation is poor. With regard to Steel number 6, the C content is outside the range of the present invention, and thus the microstructure is outside the range of the present invention and the bendability is poor.

With regard to Steel number 8, the number of times of the reduction at 1000° C. or higher at 35% or more in the rough rolling is outside the range of the present invention, and thus the average crystal grain diameter is outside the range of the present invention and the toughness is poor. With regard to Steel number 9, the time period to the start of the finish rolling is long, the average crystal grain diameter is outside the range of the present invention, and the toughness is poor.

With regard to Steel number 10, the average value of the pole densities of the {100}<011> to {223}<110> orientation group and the pole density of the {332}<113> crystal orientation are both outside the range of the present invention and the isotropy is low.

With regard to Steel number 11, the value of Tf is outside the range of the present invention, and thus the average value of the pole densities of the {100}<011> to {223}<110> orientation group and the pole density of the {332}<113> crystal orientation are both outside the range of the present invention and the isotropy is low.

With regard to Steel number 12, the value of Tf is outside the range of the present invention, and thus the average crystal grain diameter is outside the range of the present invention and the toughness is poor. With regard to Steel number 13, the value of P1 is outside the range of the present invention and at each of the rolling stands F1 to F7 in the finish rolling, the reduction at a reduction ratio of 30% or more was not performed, and thus the average value of the pole densities of the {100}<011> to {223}<110> orientation group and the pole density of the {332}<113> crystal orientation are both outside the range of the present invention and the isotropy is low.

With regard to Steel number 14, the maximum working heat generation temperature is outside the range of the present invention, and thus the average crystal grain diameter is outside the range of the present invention and the toughness is poor. With regard to Steel number 15, the time period to the primary cooling is outside the range of the present invention, and thus the average crystal grain diameter is outside the range of the present invention and the toughness is poor. With regard to Steel number 16, the primary cooling rate is outside the range of the present invention, and thus the average crystal grain diameter is outside the range of the present invention and the toughness is poor.

With regard to Steel number 17, the primary cooling temperature change is outside the range of the present invention, and thus average crystal grain diameter is outside the range of the present invention and the toughness is poor. With regard to Steel number 18, the primary cooling temperature change is outside the range of the present invention, and thus the average value of the pole densities of the {100}<011> to {223}<110> orientation group and the pole density of the {332}<113> crystal orientation are both outside the range of the present invention and the isotropy is low.

With regard to Steel number 19, the time period to the secondary cooling is outside the range of the present invention, and thus the microstructure is outside the range of the present invention, the strength is low, and the bendability is poor. With regard to Steel number 20, the secondary cooling rate is outside the range of the present invention, and thus the microstructure is outside the range of the present invention, the strength is low, and the bendability is poor.

With regard to Steel number 21, the air cooling temperature region is outside the range of the present invention, and thus the microstructure is outside the range of the present invention, the strength is low, and the bendability is poor.

With regard to Steel number 22, the air cooling temperature region is outside the range of the manufacturing method of the hot-rolled steel sheet of the present invention, and thus the microstructure is outside the range of the present invention and the elongation is poor. With regard to Steel number 23, the air cooling temperature holding time period is outside the range of the present invention, and thus the microstructure is outside the range of the present invention and the elongation is poor. With regard to Steel number 24, the air cooling temperature holding time period is outside the range of the present invention, and thus the microstructure is outside the range of the present invention, the strength is low, and the bendability is poor.

With regard to Steel number 25, the coiling temperature is outside the range of the present invention, and thus the microstructure is outside the range of the present invention and the bendability is poor. With regard to Steel number 26, the coiling temperature is outside the range of the present invention, and thus the microstructure is outside the range of the present invention, the strength is low, and the bendability is poor.

With regard to Steel number 28, the C content is outside the range of the present invention, and thus the microstructure is outside the range of the present invention, the strength is low, and the bendability is poor. With regard to Steel number 29, the C content is outside the range of the present invention, and thus the microstructure is outside the range of the present invention, the strength is low, and the bendability is poor. With regard to Steel number 30, the C content is outside the range of the present invention, and thus the microstructure is outside the range of the present invention and the elongation is poor.

INDUSTRIAL APPLICABILITY

As has been described previously, according to the present invention, it is possible to easily provide a steel sheet applicable to a member required to have workability, hole expandability, bendability, strict sheet thickness uniformity and circularity after working, and low-temperature toughness (an inner sheet member, a structure member, an underbody member, an automobile member such as a transmission, and members for shipbuilding, construction, bridges, offshore structures, pressure vessels, line pipes, and machine parts, and so on). Further, according to the present invention, it is possible to manufacture a high-strength steel sheet having excellent low-temperature toughness and 540 MPa class or more inexpensively and stably. Thus, the present invention is the invention having high industrial value.

EXPLANATION OF CODES

1 continuous hot rolling line
2 roughing mill
3 finishing mill
4 hot-rolled steel sheet
5 run-out-table
6 rolling stand
10 inter-stand cooling nozzle
11 cooling nozzle 11

What is claimed is:

1. A manufacturing method of a bainite-containing-type hot-rolled steel sheet comprising: on a slab containing: in mass%, C: greater than 0.07 to 0.2%;
Si: 0.001 to 2.5%;
Mn: 0.01 to 4%;
P: 0.15% or less (not including 0%);
S: 0.03% or less (not including 0%);
N: 0.01% or less (not including 0%);
Al: 0.001 to 2%; and
a balance being composed of Fe and inevitable impurities, performing first hot rolling on the slab in which rolling at a reduction ratio of 40% or more is performed one time or more in a temperature range of not lower than 1000° C. nor higher than 1200° C.;

performing second hot rolling in which rolling at 30% or more is performed in one pass at least one time in a temperature region of not lower than T1+30° C. nor higher than T1 +200° C. determined by Expression (1) below; and setting the total of reduction ratios in the second hot rolling to 50% or more;

performing final reduction at a reduction ratio of 30% or more in the second hot rolling and then starting primary cooling in a manner that a waiting time period t second satisfies Expression (2) below;

setting an average cooling rate in the primary cooling to 50° C./second or more and performing the primary cooling in a manner that a temperature change is in a range of not lower than 40° C. nor higher than 140° C.;

within three seconds after completion of the primary cooling, performing secondary cooling in which cooling is performed at an average cooling rate of 15° C./second or more; and after completion of the secondary cooling, performing air cooling for 1 to 20 seconds in a temperature region of lower than an Ar3 transformation point temperature and an Ar1 transformation point temperature or higher and next performing coiling at 450° C. or higher and lower than 550° C., $$T1(^\circ C.)=850+10\times(C+N)\times Mn+350\times Nb+250\times Ti+40\times B+10\times Cr+100\times Mo+100\times V \quad (1)$$

wherein, C, N, Mn, Nb, Ti, B, Cr, Mo, and V each represent the content of the element (mass%).

$$t\leq 2.5\times t1 \quad (2)$$

wherein, t1 is obtained by Expression (3) below, $$t1=0.001\times((Tf-T1)\times P1/100)^2-0.109\times((Tf-T1)\times P1/100)+3.1 \quad (3)$$

wherein, in Expression (3) above, Tf represents the temperature of the slab obtained after the final reduction at a reduction ratio of 30% or more, and P1 represents the reduction ratio of the final reduction at 30% or more.

2. The manufacturing method of the bainite-containing-hot-rolled steel sheet according to claim 1, wherein the total of reduction ratios in a temperature range of lower than T1+30° C. is 30% or less.

3. The manufacturing method of the bainite-containing-hot-rolled steel sheet according to claim 1, wherein heat generation by working between respective passes in the temperature region of not lower than T1+30° C. nor higher than T1+200° C. in the second hot rolling is 18° C. or lower.

4. The manufacturing method of the bainite-containing-hot-rolled steel sheet according to claim 1, wherein the waiting time period t second further satisfies Expression (4) below, $$t<t1 \quad (4).$$

5. The manufacturing method of the bainite-containing-hot-rolled steel sheet according to claim 1, wherein the waiting time period t second further satisfies Expression (5) below, $$t1\leq t\leq t1\times 2.5 \quad (5).$$

6. The manufacturing method of the bainite-containing-hot-rolled steel sheet according to claim 1, wherein the primary cooling is started between rolling stands.

* * * * *